US007217006B2

(12) United States Patent
Trenchard et al.

(10) Patent No.: US 7,217,006 B2
(45) Date of Patent: May 15, 2007

(54) VARIATION OF POWER LEVELS WITHIN AN LED ARRAY

(75) Inventors: Stephen E. Trenchard, Kingwood, TX (US); Alan Trojanowski, Dayton, TX (US)

(73) Assignee: Automatic Power, Inc., Houston, TX (US)

( * ) Notice: Subject to any disclaimer, the term of this patent is extended or adjusted under 35 U.S.C. 154(b) by 260 days.

(21) Appl. No.: 11/034,327

(22) Filed: Jan. 12, 2005

(65) Prior Publication Data

US 2006/0109648 A1 May 25, 2006

Related U.S. Application Data

(60) Provisional application No. 60/629,856, filed on Nov. 20, 2004.

(51) Int. Cl.
*F21V 29/00* (2006.01)

(52) U.S. Cl. ..... 362/249; 362/235; 362/311; 362/331

(58) Field of Classification Search ..... 362/235, 362/249, 294, 311, 331, 477, 540, 545
See application file for complete search history.

(56) References Cited

U.S. PATENT DOCUMENTS 1,764,622 A 6/1930 Goodwin
3,221,162 A * 11/1965 Heenan et al. ..... 362/477
4,360,862 A 11/1982 Strasser et al.
4,463,399 A 7/1984 Matherly et al.
5,140,220 A 8/1992 Hasegawa
5,224,773 A 7/1993 Arimura
5,237,490 A * 8/1993 Ferng ..... 362/183
5,585,783 A 12/1996 Hall
5,608,290 A 3/1997 Hutchisson et al.
5,664,866 A 9/1997 Reniger et al.
5,769,532 A 6/1998 Sasaki
5,821,695 A 10/1998 Vilanilam et al.
5,833,355 A 11/1998 You et al.
5,857,767 A 1/1999 Hochstein
5,899,557 A 5/1999 McDermott
5,931,570 A 8/1999 Yamuro
5,947,588 A 9/1999 Huang
6,013,985 A 1/2000 Green et al.
6,048,083 A 4/2000 McDermott
6,135,612 A 10/2000 Clore
6,425,678 B1 * 7/2002 Verdes et al. ..... 362/244
6,525,668 B1 * 2/2003 Petrick ..... 340/815.45
2001/0030866 A1 10/2001 Hochstein
2002/0114170 A1 8/2002 Chen et al.

OTHER PUBLICATIONS

A19 Style 3D PedLED Solid-State Light Bulb, Ledtronics, Inc., Jun. 24, 2002.
Dialight 860 Series LED Obstruction Light, Dialight Corporation, Farmingdale, NJ, date unknown.

(Continued)

*Primary Examiner*—John Anthony Ward
(74) *Attorney, Agent, or Firm*—Elizabeth R. Hall

(57) ABSTRACT

A lighting device having a plurality of high flux LEDs mounted on a heat sink and surrounded by a diffuser and a power supply that provides independent power to individual sets of the LEDs. The heat sink serves to transfer heat from the LEDs to the outside environment. In one embodiment the lighting device is positioned within a fresnel lens to produce a distribution of light.

29 Claims, 17 Drawing Sheets

OTHER PUBLICATIONS

LED Obstruction Light Lasts Longer for Less Maintenance, Dialight Corporation, Farmingdale, N.J., Nov. 29, 2001.

Dialight Corporation Offers First LED-Based Flasking Bed Beacon, Dialight Corporation, Farmingdale, N.J., Jun. 25, 2001.

* cited by examiner

VARIATION OF POWER LEVELS WITHIN AN LED ARRAY

CROSS REFERENCE TO RELATED APPLICATIONS

This application claims priority to pending U.S. patent application Ser. No. 60/629,856, filed Nov. 20, 2004 by inventors Stephen E. Trenchard and Alan Trojanowski and entitled "Variation of Power Levels within an LED This application for patent is related to pending U.S. patent application Ser. No. 10/695,191, filed Oct. 28, 2003 by inventors Stephen E. Trenchard and Alan Trojanowski and entitled "High Flux LED Lighting Device."

BACKGROUND OF THE INVENTION

1. Field of the Invention

The present invention relates generally to a lighting device having high flux light emitting diodes, or LEDs, mounted on a heat sink and surrounded by a diffuser. The present invention further relates to an LED assembly having multiple layers of LEDs mounted on a heat sink and surrounded by a diffuser, wherein the LED assembly is positioned within a fresnel lens and individual power is provided to each layer of LEDs.

2. Description of the Related Art

Reliable safety lights are critical for the safety of boats to prevent accidental collisions during darkness and inclement weather. The vast majority of marine safety lights, such as the one disclosed in U.S. Pat. No. 5,711,591 issued to Jordan use incandescent light bulbs as the light source.

A number of attempts have been made to replace marine filament bulbs with LEDs in marine safety lights because of their relatively small power consumption and long life. Incandescent bulbs have a resistant tungsten filament suspended by support wires with a vacuum inside a glass bulb. As a result, they are highly susceptible to damage due to temperature variations and vibrations. The typical life of incandescent bulbs usually averages one or two thousand hours, so that they must be replaced several times a year.

LEDs, on the other hand, are more efficient than bulbs at converting electricity into light. LEDs are also durable and immune to filament breakage due to shock or vibration. Therefore, LEDs have a life span of approximately 50,000 hours versus one to two thousand hours for an incandescent bulb. This means that the bulbs do not have to be replaced nearly so often and do not require much maintenance. This is particularly important for marine lanterns that are difficult to get to.

However, LEDs are not without their problems. Several of these problems are discussed in a paper entitled *Design Considerations for Reliability and Optical Performance of LED Signal Lights* given by Paul F. Mueller at the XVth IALA Conference, March 2002.

A first problem is that typical low output 5 millimeter LEDs (currently available in lighting devices such as those used for marine and airport safety lights) only have a driving current ranging from about 50 to 70 milliwatts and put out insufficient lumens or candlepower to meet the 3–4 mile visibility requirement. Although it is possible to increase the optical output considerably by increasing the forward current above the nominal rated value, such an increase in forward current generally leads to premature failure due to overheating of the diode junction. Recently, however, high-output LEDs (driving current of about 1–5 Watt with a high lumens output) have become available.

A second problem is that LEDs have a poorly directed, non-uniform and excessively divergent pencil beam pattern. It is customary to produce a 360° beam pattern of superimposed pencil beams by arraying multiple LED sources in a circular, outward-directed pattern. While this provides an omni-directional beam pattern, lacking further optical enhancement, the result is energy inefficient and grossly non-uniform in horizon intensity.

There are several major manufacturers that produce marine lanterns with LEDs including: Carmanah Technologies, Inc., Zeni Buoy Light Company Limited, Vega Industries Limited, Tideland Signal Corporation, and Sabik Oy. All of the currently available marine lanterns using LEDs use low output LEDs. Thus, all of these lanterns require large numbers of, up to several hundred, LEDs to produce the minimal total flux (lumens or candlepower) necessary for a marine lantern.

Marine LED lanterns use multiple arrays of numerous LEDs that do not have a single point source of light and cannot use a fresnel lens to capture and focus the light from the LED arrays used. All five of the manufacturers mentioned above have been required to design new lenses to capture and focus the light from their LED arrays.

One approach to this problem has been to design a fine lens incorporated in front of the LEDs to converge the beam of light and increase the luminance thereof. For example, U.S. Pat. No. 5,224,773 discloses a thin fresnel lens made by rolling and welding the edges of a thin, transparent film of acrylic resin with a fine-pitched surface that is formed by heating and pressing a mold for a thin linear fresnel lens to form a cylinder.

Alternatively, U.S. Pat. No. 6,048,083 issued to McDermott describes an optic lens that is contoured to create a plurality of focal points which form a bent or crooked focal line cooperate with the orientation of the LED elements to project a composite light beam with limited divergence about a first reference plane.

Another approach has been to construct a small marine safety light that has a much lower candlepower. U.S. Pat. No. 6,086,220 issued to Lash et al. describes a marine safety light having six or more low output LEDs having a uniform star configuration. The inventors determined that such an LED array produced visible light over one nautical mile away from the vessel, whereas most marine lanterns must meet a 60 candela requirement for a three to four mile visibility.

There is an existing need for a marine lantern that replaces the incandescent bulb with LEDs that has sufficient candlepower and provides an omni-directional beam pattern. There is a further need to provide highly efficient LED lanterns to meet the 3–4 mile nautical visibility requirement and other performance specifications for various marine and aeronautical uses.

SUMMARY OF THE INVENTION

The present invention combines the use of high flux LEDs, configured in multi-level LED modules, with independently provided electrical power for each of the LED modules to meet differing performance specifications.

The LED assembly has at least three stacked levels of LED modules with each of the LED modules having an array of radially disposed LEDs around a central member which is made of thermally conductive material for transferring the heat from the LEDs to the outside environment. The power supply provides individual, independent electrical power for each of the LED modules to allow the LED modules to operate at different power levels.

One aspect of the present invention is a lighting device comprising: (a) a plurality of LEDs disposed in three stacked radial arrays about a vertical axis; (b) a central member having each LED mounted on a vertical surface thereof, the central member made of a thermally conductive material to conduct heat away from the LEDs; (c) a power supply for each level of LEDs to allow the application of different power levels to the different levels of LEDs; and (d) a hollow member having a dentated surface, wherein the dentated surface surrounds the LEDs to diffuse the light emitted from the LEDs.

Another aspect of the present invention is a lighting device comprising: (a) a lighting assembly having (i) a heat sink having at least three centralized right angle prisms, each with a square horizontal cross-section with a plurality of vertical surfaces, (ii) a plurality of equispaced LEDs, each LED mounted on a vertical surface of the heat sink, and (iii) a tubular diffuser having a frosted surface, wherein the frosted surface surrounds the LEDs to diffuse the light emitted from the LEDs; (b) an individual power supply for each level of LEDs; and (c) a fresnel lens surrounding the lighting assembly; whereby light emanating from the LEDs passes through the diffuser and the fresnel lens to provide a substantially uniform horizontal plane of light.

Yet another aspect of the present invention is a lighting assembly comprising: (a) a plurality of equispaced high flux LEDs; (b) a controller for conditioning electric power for the LEDs; (c) a heat sink for transferring heat from the LEDs, wherein each LED is secured to the heat sink; and (d) a tubular diffuser surrounding the LEDs having a roughened surface with a random pattern of microfaceted angles on the surface, wherein the microfaceted angles diffuse the light emitted from the LEDs.

The foregoing has outlined rather broadly several aspects of the present invention in order that the detailed description of the invention that follows may be better understood and thus is not intended to narrow or limit in any manner the appended claims which define the invention. Additional features and advantages of the invention will be described hereinafter which form the subject of the claims of the invention. It should be appreciated by those skilled in the art that the conception and the specific embodiment disclosed may be readily utilized as a basis for modifying or designing of the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
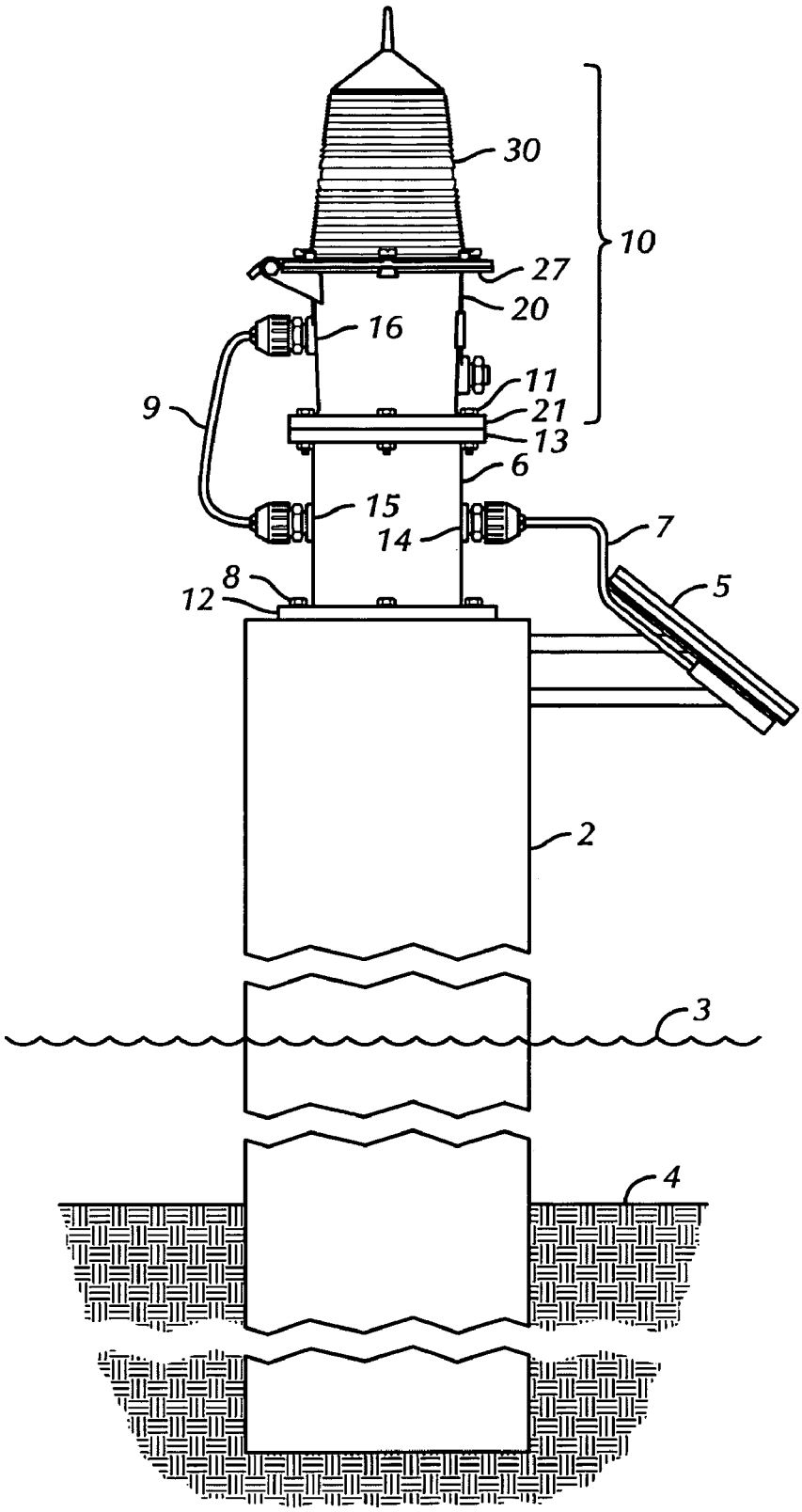
FIG. 1 is a plan view in partial section of a typical installation of a lighting device of the present invention mounted on a marine piling.

One embodiment of the present invention relates to a lighting device using high flux light emitting diodes (LEDs)

mounted on a heat sink in a conventional fresnel lens having a diffuser positioned between the LEDs and the fresnel lens. High flux LEDs are defined herein as LEDs with driving current of about 1–5 Watts and having a high output of lumens. This embodiment is described below.

Referring now to the drawings, it is noted that like reference characters designate like or similar parts throughout the drawings. The figures, or drawings, are not intended to be to scale. For example, purely for the sake of greater clarity in the drawings, wall thicknesses and spacings are not dimensioned as they actually exist in the assembled embodiments.

Figure 2:
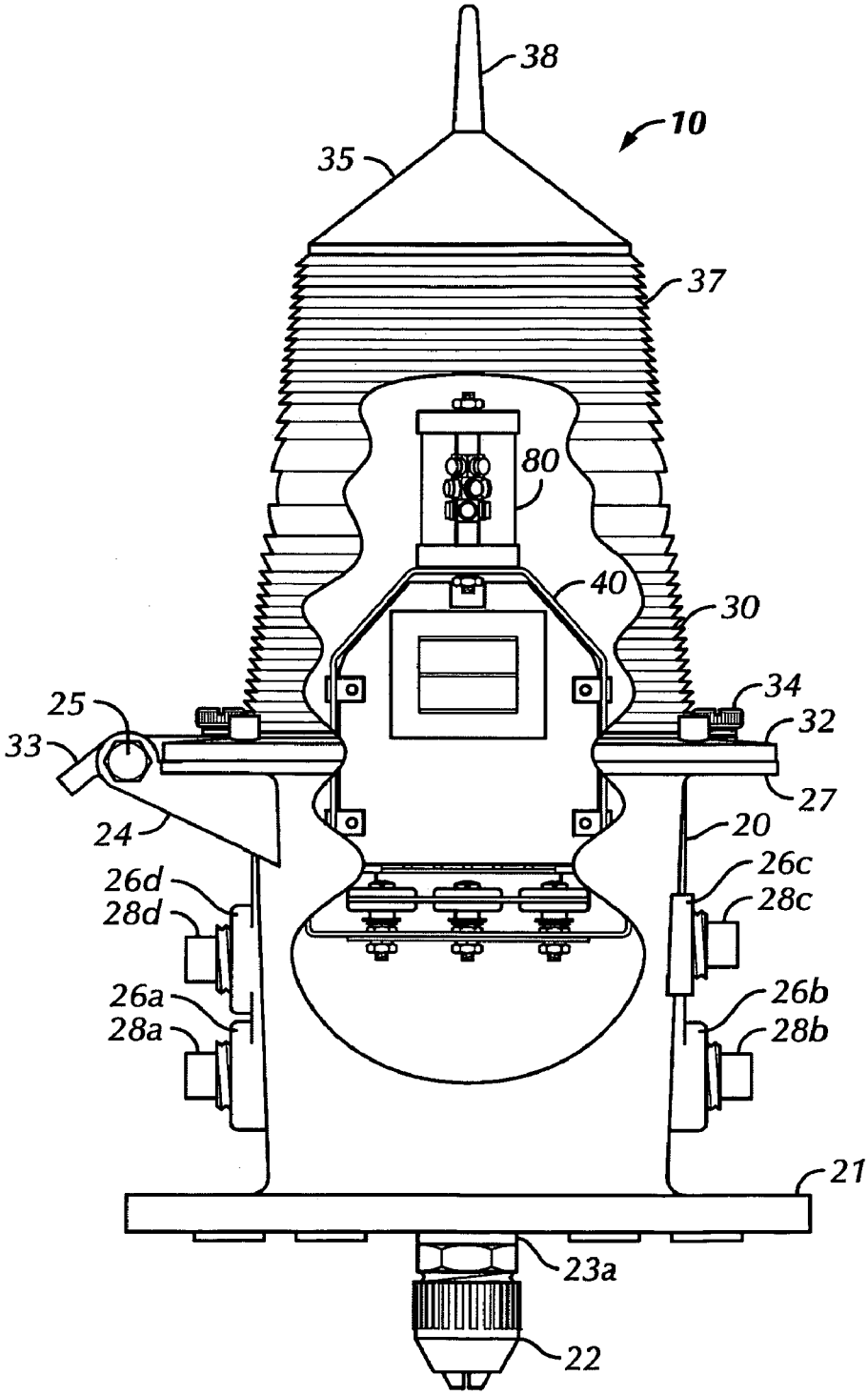
FIG. 2 is a profile view, partially in section, showing the LED source module of the lighting device and its mounting base.

Several embodiments of the lighting device of the present invention are described in detail below. One preferred embodiment of a lighting device 10 of the present invention, shown in FIGS. 1 and 2, is often installed on bridges, offshore platforms, airport towers, marine beacons, and the like. FIG. 1 illustrates an example of the lighting device 10 installed as a marine beacon. This type of installation is commonly used on remote channel markers for navigable waterways. A piling 2 of treated wood, concrete, pipe or other applicable material is driven into the soil below a mudline 4 to support the lighting device 10 high enough above a water surface 3 to prevent the lighting device 10 from being damaged by wakes, waves, and the like.

The lighting device 10 is optionally powered by batteries (not shown) contained in a tubular battery case 6 that has a closed bottom flange 12 and an annular top flange 13. The lighting device 10 is mounted to the top of the battery case 6 with base attachment bolts 11 and the battery case 6 is attached to the top of the piling 2 with bolts 8. In this embodiment, the batteries located in the interior of case 6 are recharged by electricity generated by a solar panel assembly 5 and transferred to the batteries via a solar collector cable 7 as shown in FIG. 1. The cable 7 penetrates into the side of case 6 through a sealing fitting 14. The solar panel assembly 5 is mounted on the piling 2 or, alternatively (not shown), on battery case 6.

A power cable 9 emerges from a sealing fitting 15 in the side of case 6 to transfer electricity from the battery case 6 to the lighting device 10. In the embodiment shown in FIG. 1, the power cable 9 enters the side of a mounting base 20 of lighting device 10 through a sealing fitting 16. As an alternative, the power cable 9 could be attached to a fitting 22 at the bottom of the lighting device 10 (as shown in FIG. 2) to transfer electricity from the battery case 6 to the lighting device 10. Without departing from the spirit of the invention, the electrical power also could be supplied by other configurations such as from a remote external source via a supply cable (not shown). In other configurations, the battery case 6 and/or the solar panel assembly 5 could be omitted or modified to work with a different exterior power supply (not shown).

Unless noted as being made of specific materials, the lighting device 10 of the present invention can be made of a variety of materials as long as the materials meet the desired performance specifications. The construction materials in the preferred embodiment are steel or aluminum alloy for structural items and insulated copper wire for wiring connections.

Figure 3:
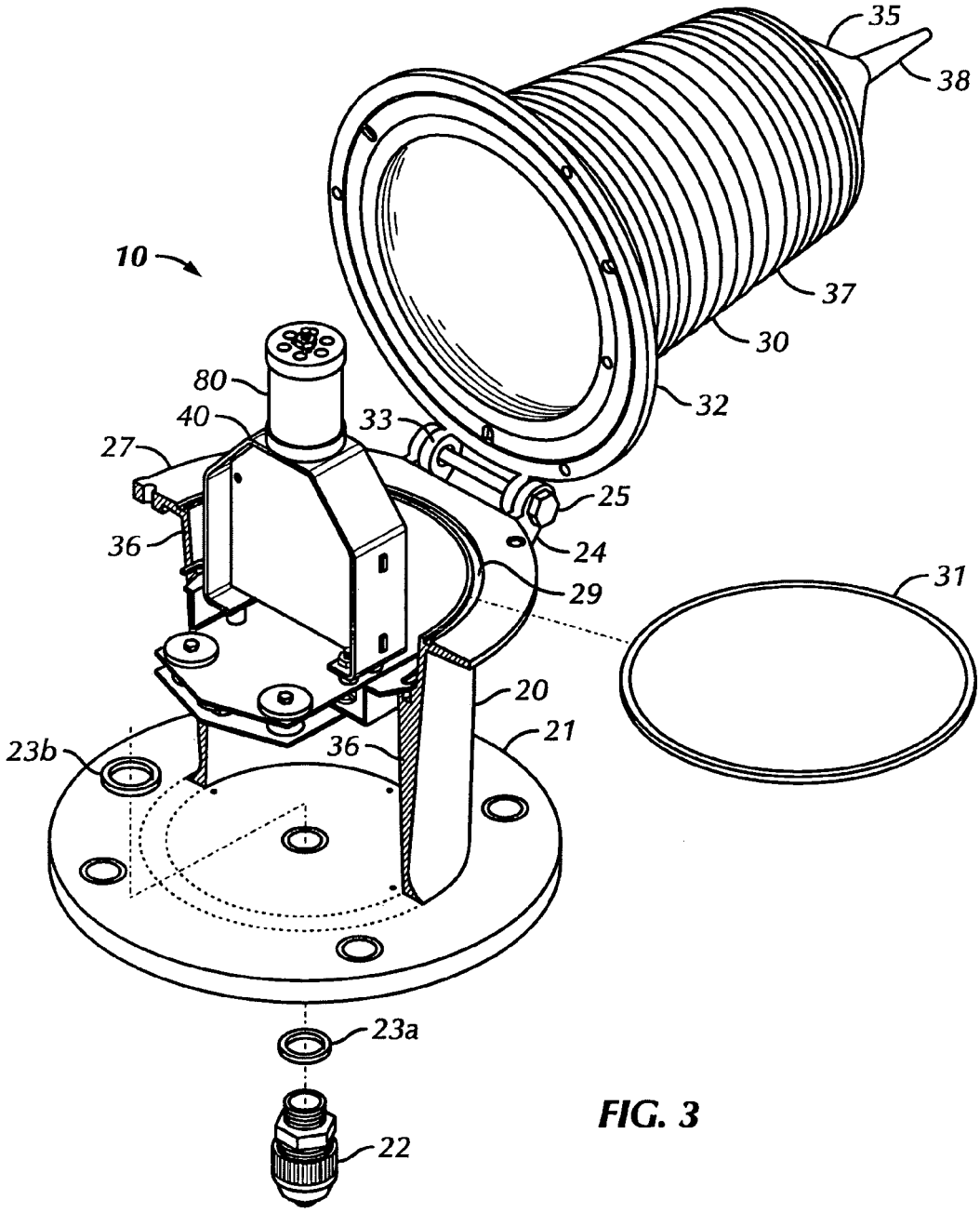
FIG. 3 is a partially exploded oblique view, partially in section, showing one embodiment of the mounting of the LED source module on the mounting base.

FIGS. 2–3 show general details of the lighting device 10 and specifically the interrelationship of the mounting base 20, a lantern lens assembly 30 and a light-emitting diode (LED) source assembly 80 (FIG. 3) which is the source of the light from the lighting device 10. The mounting base 20 is a tubular, substantially right-circular cylinder with a right circular cylindrical lower transverse blind mounting flange 21 and a transverse annular top flange 27. The mounting base 20 is typically a painted aluminum casting and its approximately cylindrical wall surfaces are slightly conical in shape to provide draft for the extraction of the casting patterns (not shown). A bolt circle of holes in the mounting flange 21 accommodate bolts 11 so that mounting base 20 can be bolted to corresponding tapped holes in the battery case 6 (FIG. 1).

The mounting flange 21 has an axial tapped hole, which mounts a commercially available sealing cable fitting 22 so that a power cable (not shown) can enter the lighting device 10 through the bottom of the mounting base 20 instead of the side of the mounting base 20 as shown in FIG. 1. Annular gasketed sealing washers 23*a,b* seal the exterior and the interior respectively of the joint between fitting 22 and flange 21 (FIG. 3). In the arrangement shown in FIG. 2, the sealing cable fitting 22 extends downwardly into the battery case 6 and serves to isolate the interior of the mounting base 20 from potentially corrosive conditions within the battery case 6.

Mirror image hinge brackets 24, extending outwardly from the exterior of mounting base 20 adjacent to top flange 27, are symmetrically offset from a vertical plane through the axis of the mounting base 20 and have coaxial hinge holes (not shown) normal to the vertical plane. The axis of the hinge holes in hinge brackets 24 is approximately at the level of the upper surface of top flange 27. A hinge pin 25 consists of a bolt and nut and is mounted through the hinge holes of hinge brackets 24.

External threaded bosses 26*a,b,c,d* (FIG. 2) on the approximately cylindrical outer wall of mounting base 20 are drilled and tapped for alternative power cable entry locations (such as shown in FIG. 1), which are shown sealed with threaded plugs 28*a,b,c,d*, but which could likewise be used to mount the sealing cable fitting 22.

The upper transverse face of top flange 27 has a concentric O-ring groove 29 for mounting a face-sealing O-ring 31 (FIG. 3). Additionally, top flange 27 is provided with a concentric bolt circle of tapped holes.

Mirror-image, inwardly projecting bosses 36 with transverse upper shoulders are located in the bore of mounting base 20. These bosses 36 are provided with drilled and tapped mounting holes parallel to the axis of mounting base 20 in order to mount a controller assembly 40 of the lighting device 10.

The lantern lens assembly 30 is positioned on top of and coaxially with mounting base 20. A lens base 32 is an annular ring flange with a concentric bolt circle of holes corresponding to that of the top flange 27 of mounting base 20 and having a shallow counterbore on its under side. Radially projecting to one side of lens base 32 is a lens hinge 33, which constitutes a rectangular tab having at its outer end a transverse eye hole formed in an outer end enlargement. The axis of the eye hole of lens hinge 33 is aligned with the transverse hinge holes in hinge bracket 24 of mounting base 20 when the lantern lens assembly 30 is aligned with and resting on the top flange 27 of the mounting base 20.

A thin-walled lens body 35 has, from its lower end, an annular flange, a slowly tapering elongated large diameter frustro-conical main body portion, a short frustro-conical transition section of intermediate diameter, and a sharp small diameter conical bird spike 38 section at its top. All of the conical sections taper upwardly. The function of the bird spike 38 is to discourage birds from perching on and fouling the lens body 35.

The exterior of the main portion of lens body 35 both above and below a central portion (termed the "bulls eye" and shown in FIG. 2) is annularly grooved in a mathematically determined pattern which constitutes a standard fresnel lens 37 of the type conventionally used to focus light from a centrally located point or point source into a horizontal beam. The pattern of the annular grooves is approximately mirror imaged about the midplane of the bulls eye, but with slight modifications due to the conical pattern of the lens body 35.

The lens body 35 is positioned coaxially with lens base 32 with the bottom flange of the lens body retained within the counterbore of the lens base 32 and held so that the bottom flange of the lens body 35 may be clamped against the top flange 27 of the mounting base 20. O-ring 31 (FIG. 3) is positioned in groove 29 of the mounting base 20 and seals between the lens body 35 and the mounting base 20. After the lens body 35 is positioned against the top flange 27, lens closure screws 34 are positioned in the bolt circle holes of lens base 32 and screwed into the threaded bolt circle holes of the top flange 27 of the mounting base 20, so that the lantern lens assembly 30 is firmly mounted to the mounting base 20.

Figure 4:
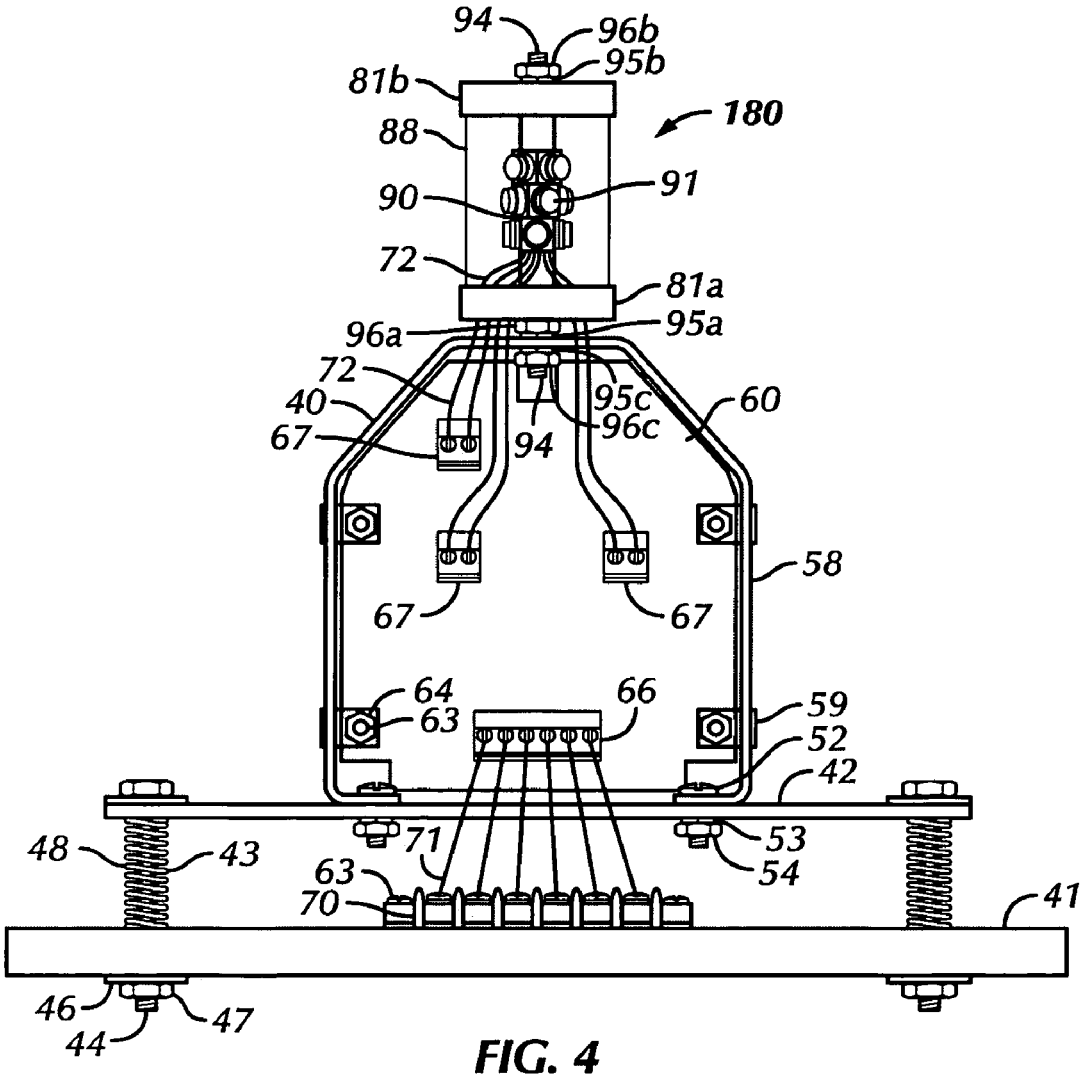
FIG. 4 shows a profile view showing details of the mounting of the controller assembly and the LED source assembly.
Figure 5:
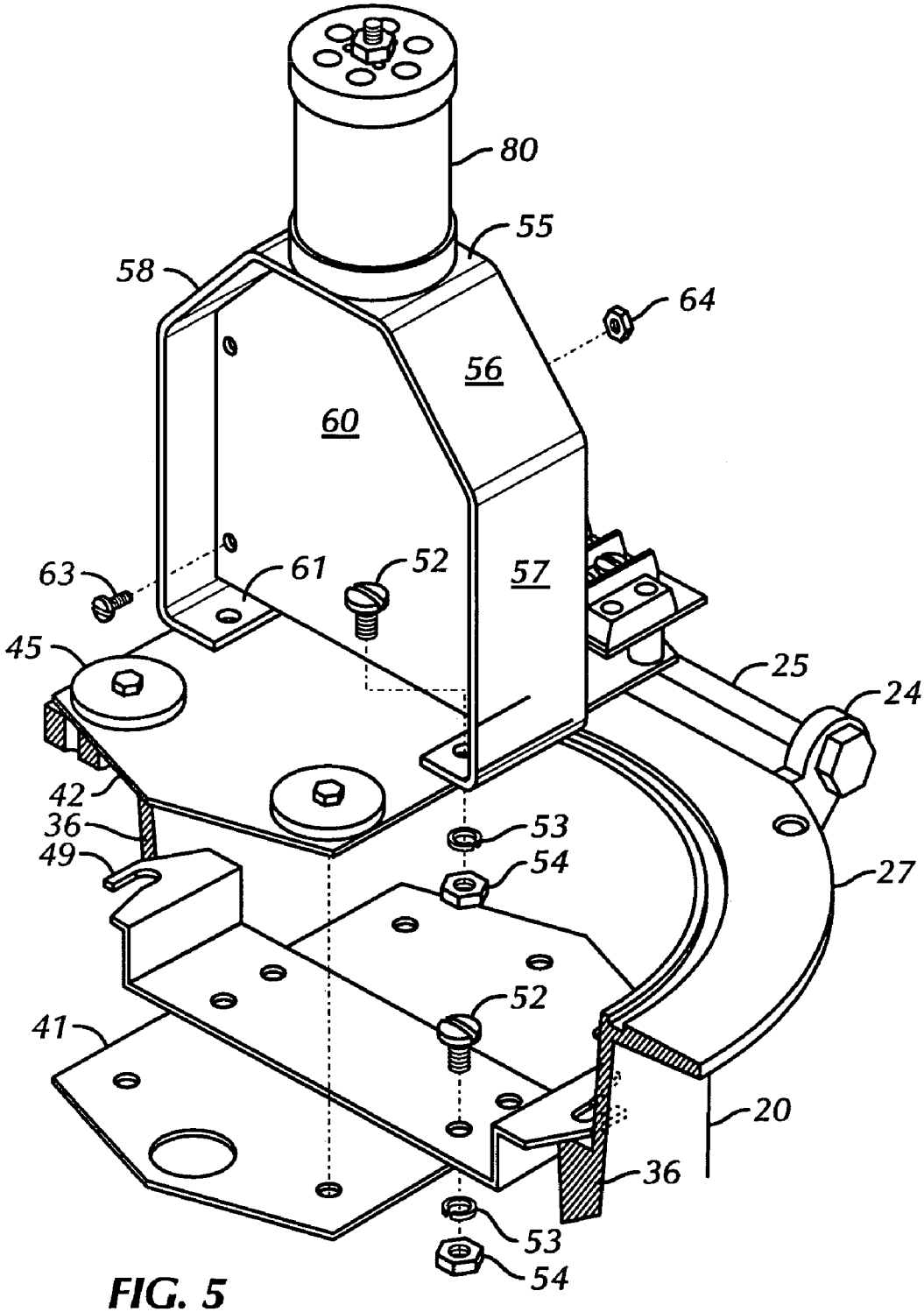
FIG. 5 is a partially exploded oblique view, partially in section, showing details of the mounting of the lighting device.

In FIGS. 4 and 5, the structure of one embodiment of the controller assembly 40 is shown. FIG. 4 is a profile view showing the details of the shock resistant mounting of the controller assembly 40. The controller assembly 40 serves to provide appropriate, conditioned electrical power and, if desired, a programmable blinking pattern for the LEDs 91 and differing power amounts to the individual levels of LEDs (described below).

A base plate 41 in the preferred embodiment is a thin flat steel plate of hexagonal shape and dual symmetry with multiple mounting holes and access holes cut into it so that other components can be mounted to it and the mountings for other components can be accessed. A carrier plate 42 is similar to base plate 41, but with a different pattern of mounting holes and access holes. The carrier plate 42 is positioned parallel to and above the base plate 41. Three or more spring mount assemblies 43 with their axes not lying on a common line are positioned in mounting holes on corresponding corners of base plate 41 and carrier plate 42 to support the carrier plate 42. Four spring mount assemblies are used in the preferred embodiment, two of which are shown in FIG. 4. The spring mount assembly 43 consists of a spring mount screw 44 with, in sequential order from the upper end, the head of the screw 44, a flat washer 45, the carrier plate 42, a standoff spring 48, the base plate 41, a washer 46 and a nylon insert lock nut 47. Washers 45 and 46, spring 48 and nut 47 are concentric with screw 44. The nut 47 is sufficiently threaded onto the screw 44 so that the spring 48 is preloaded in compression.

As shown in FIG. 5, a U-bracket 49 is formed from a strip of thin plate approximately 2 inches wide that has two outwardly projecting coplanar ears, each adjoining a symmetrical vertical leg, and a central horizontal section supported by the vertical legs. The outer ends of the ears of bracket 49 have similar but oppositely facing parallel slots transverse to the longitudinal mid-plane of the U-bracket 49. This is to allow the U-bracket 49 to be readily slipped in and out of engagement with vertically projecting headed screws (not shown) mounted on the interior bosses 36 of mounting base 20 by rotating it about its vertical axis without removal and reinstallation of the screws. U-bracket 49 is in turn rigidly mounted to the interior bosses 36 in the bore of mounting base 20 by means of screws engaged in its slots.

Two sets of mounting holes for attaching the base plate 41 are located at either side of the central horizontal section of U-bracket 49. Base plate 41 is rigidly mounted in its center to the lower side of U-bracket 49 by screws 52, lock washers 53, and nuts 54 at two sets of holes on opposed sides of its central portion corresponding to the mounting holes in the central portion of bracket 49.

A printed circuit board (PCB) bracket 58 (FIGS. 4 and 5), formed from a thin strip of plate, is symmetrical about its vertical mid-plane perpendicular to the plate strip longitudinal axis. The PCB bracket 58 has a horizontal central upper section 55 adjoined by two inclined segments 56, which are in turn attached to vertical legs 57 that have inwardly projecting horizontal mounting tabs 61 on their bottom ends. The PCB bracket 58 is mounted in a central position to carrier plate 42 by means of two other sets of screws 52, lock washers 53 and nuts 54.

Three mounting holes (not shown) for the LED source assembly 80 are provided on the horizontal central upper section 55 of PCB bracket 58. One hole is in the middle of the horizontal central upper section 55 and two others are symmetrically placed straddling the first hole.

Multiple PCB mounting tabs 59 are mounted in transverse slots pierced in the thin plate of bracket 58 and welded or soldered in place. A controller PCB 60 is a flat construction of conventional printed circuit board material having a shape that closely fits within the interior of the PCB bracket 58

If the incoming electrical power is AC, then it is rectified to DC on the controller PCB 60. The input current and voltage are adjusted and regulated to provide appropriate polarities, voltages, current limits, power levels, and timing of any blinking functions desired for individual LED modules 90 in the LED source assembly 80.

The controller PCB 60 is mounted to the tabs 59 by means of screws 63 and nuts 64. A PCB controller terminal strip 66 is rigidly mounted onto the lower end of controller PCB 60 and the individual terminals of the PCB terminal strip 66 are attached to appropriate conductor paths on controller PCB 60. Similarly, in the preferred embodiment, three light emitting diode (LED) power terminals 67 (each with two terminals for its respective LED module 90) are mounted at the upper end of the controller PCB 60 and interconnected to appropriate circuit conductor paths on the printed circuit board.

A base terminal strip 70 is rigidly mounted to the upper surface of base plate 41 by means of screws 63 engaged in tapped holes in the base plate 41. Alternatively, base terminal strip 70 may be similarly mounted to carrier plate 42. Main leads 71 are discrete insulated wires that are each connected at their first end to one of the terminals of the base terminal strip 70 and at the second end at its corresponding terminal on the PCB terminal strip 66.

Multiple embodiments of the LED source assembly 80 are possible and several (80, 180, 380 and 480) are described below. The first embodiment of the LED source assembly 80, shown in the exploded view of FIG. 6, consists primarily of housing elements for an LED assembly 89. This embodiment is most suitable for use with one to two Watt high flux LED light sources, which generate less heat than the five Watt high flux LED sources. Generally when five Watt LEDs are used in this embodiment, some of the LEDs 91 are driven at a lower power level than the other LEDs 91 to save energy and to allow an overall cooler operation of the LED source assembly 80 as described in more detail below.

A bottom base 81*a* is a right circular disk having a central axial through hole and a concentric annular O-ring face seal groove 82*a* having a depth in excess of that necessary to properly house O-ring 83*a* (FIG. 7) on its upper surface. Base 81*a* also has an equispaced array of multiple primary vent holes 84 located on a first radius, an equispaced array of multiple secondary vent holes 85 smaller than holes 84 and located on a smaller second radius, and two threaded holes 86 in diametrically opposed positions for the purpose of providing an optional mounting (not shown) of the LED source assembly 80. All of the holes 84, 85, and 86 are parallel to the axis of disk 82*a*. The threaded holes 86 are spaced similarly to those straddling the central hole on the horizontal central upper section of bracket 58.

Figure 7:
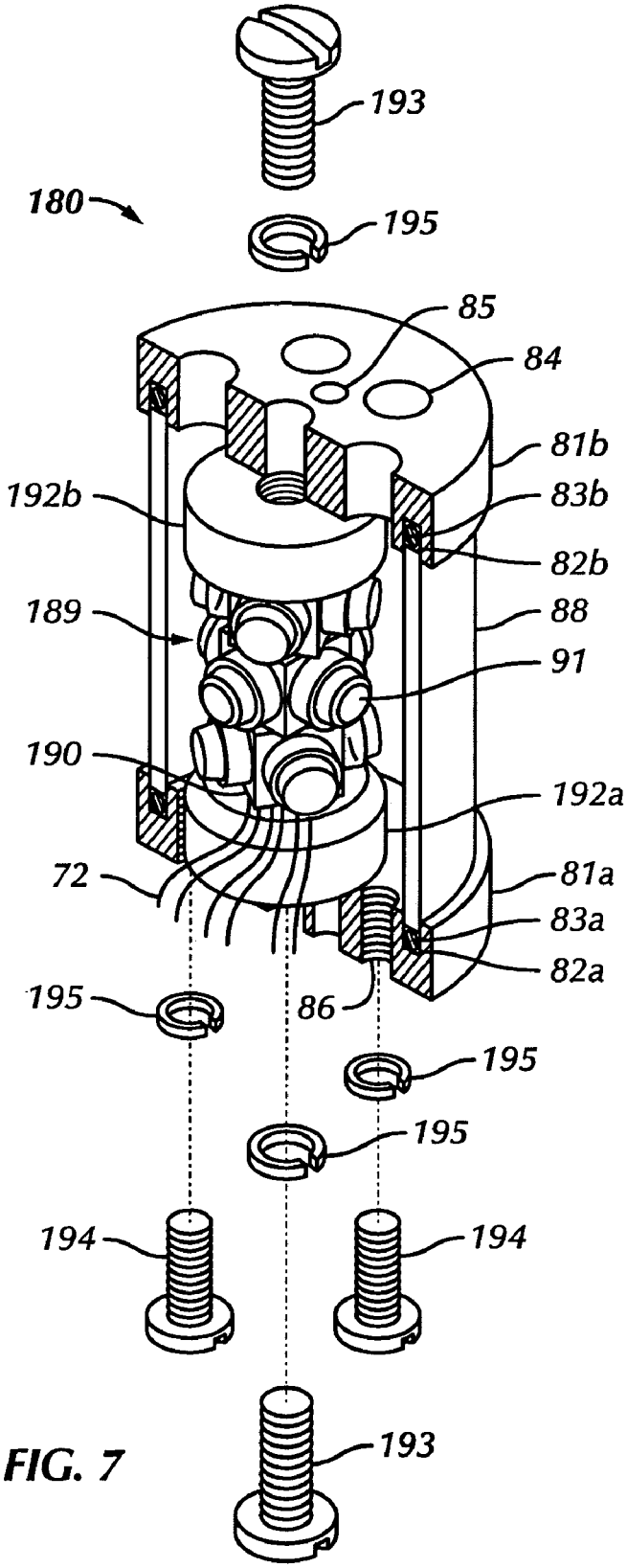
FIG. 7 is a partially exploded oblique view, partially in section, showing details of another embodiment of the LED source assembly.

An upper base 81*b*, which is inverted relative to lower base 81*a*, is substantially identical to the lower base 81*a* except for the optional omission of threaded holes 86. An O-ring groove 82*b* of upper base 81*b* houses an O-ring 83*b* (FIG. 7).

To neutralize the possibility of non-uniform light dispersion when using high flux LEDs 91 instead of very large numbers of lower power LEDs of prior designs, the present invention incorporates an optical diffuser 88 to redistribute the light emitted from the LEDs 91 in a more uniform manner in spherical coordinates. This feature of the present invention, in combination with the other aforementioned features, provides the characteristics necessary for enabling a compact LED lighting device 10 that can be used for new installations as well as for retrofitting the population of existing lighting devices designed for incandescent bulb sources.

Figure 6:
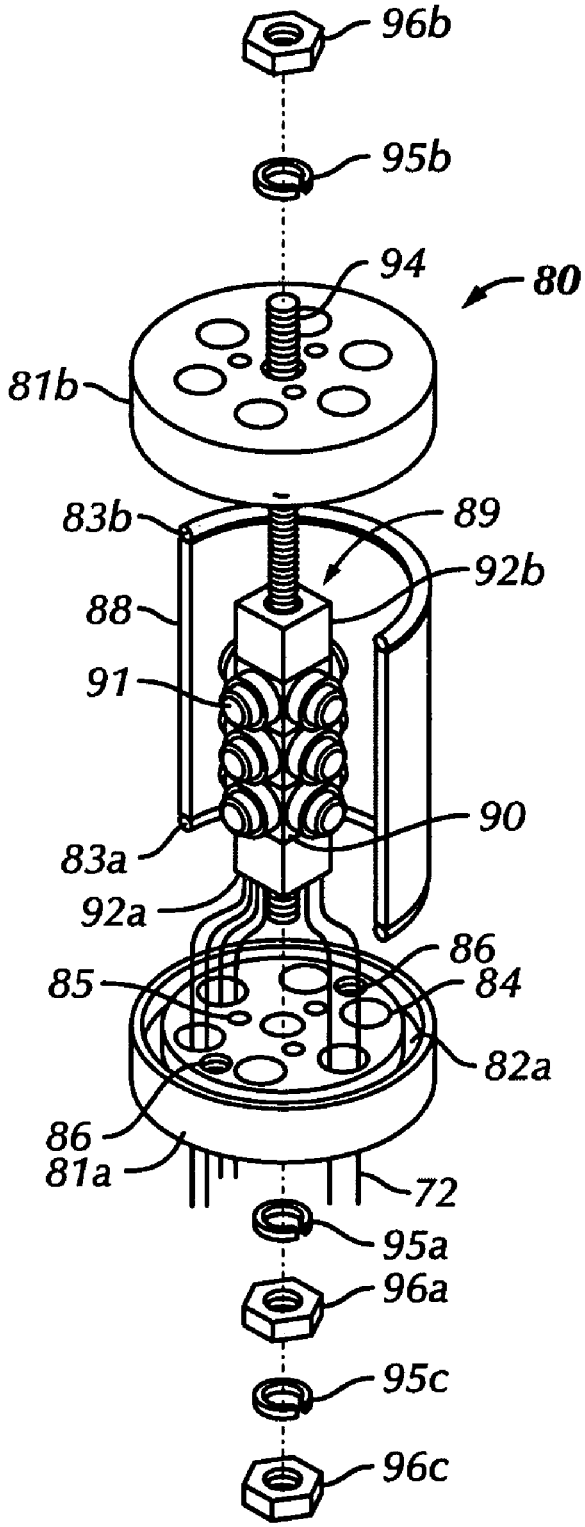
FIG. 6 is a partially exploded oblique view, partially in section, showing details of one embodiment of the LED source assembly.

The diffuser 88, as shown in FIG. 6, is a right circular thin-walled tube made of plastic, glass or any other material that is clear, heat resistant and satisfies the structural and optical requirements of the diffuser 88. In the preferred embodiment, the diffuser 88 is made of fused quartz or borosilicate or crown glass or a similar optically clear, heat resistant glass. The inner diameter of diffuser 88 is greater than the inside diameter of O-ring groove 82*a*, and the outer diameter of the diffuser 88 is a close fit to the inner diameter of groove 82*a* so that the diffuser 88 may be positioned concentrically with the base 81*a*.

The diffusion properties of the diffuser 88 result from a roughened microfinish (not shown) on at least one of the surfaces of the diffuser 88 that surrounds the LED assembly 89. As the random lay pattern of one or more surfaces of the diffuser 88 is increased, the uniformity of the light emitted from the diffuser 88 also increases. For example, in one embodiment the inner bore of diffuser 88 is smooth, while the outer cylindrical surface of diffuser 88 is dentated (not shown), such as being uniformly frosted by sand blasting or other suitable means, so that the roughened outer surface has a statistically consistent random pattern of microfacet angles. Alternatively, the inner bore may be dentated or frosted (not shown) rather than the outer surface or both the inner and outer surfaces may be frosted.

Figure 8:
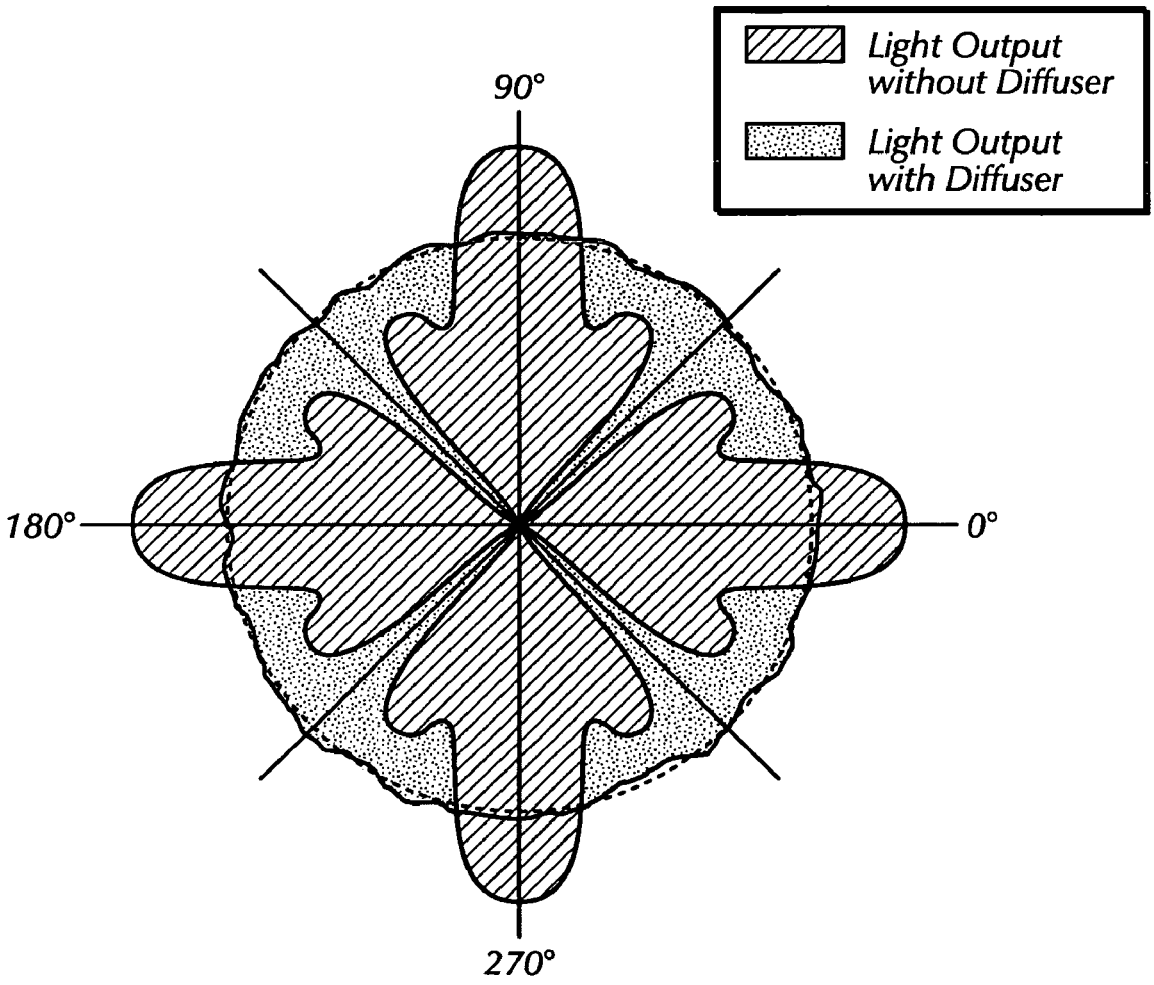
FIG. 8 is a polar coordinate diagram illustrating the circumferential variation in light output from the lighting device of the present invention with and without use of a diffuser.

The dentated surface of the diffuser 88 is able to refract incoming light emanating from the LEDs 91 in such a manner that the intensity of the light emitted from the diffuser 88, as measured in spherical coordinates, is substantially uniformized for the angles of admissivity of the fresnel lens 37 (FIG. 3) in combination with the LED source assembly 80. This substantial uniformization is demonstrated by the measured results shown in FIG. 8, wherein the emitted light intensity on the horizontal midplane of the LED source assembly 80 is shown both without and with the diffuser 88.

As an alternative (not shown), the inner bore of diffuser 88 may be frosted, rather than the outer surface, with the resultant diffusion and substantial uniformization of the emitted light being similar to that for the frosting on the outer surface.

Figure 9:
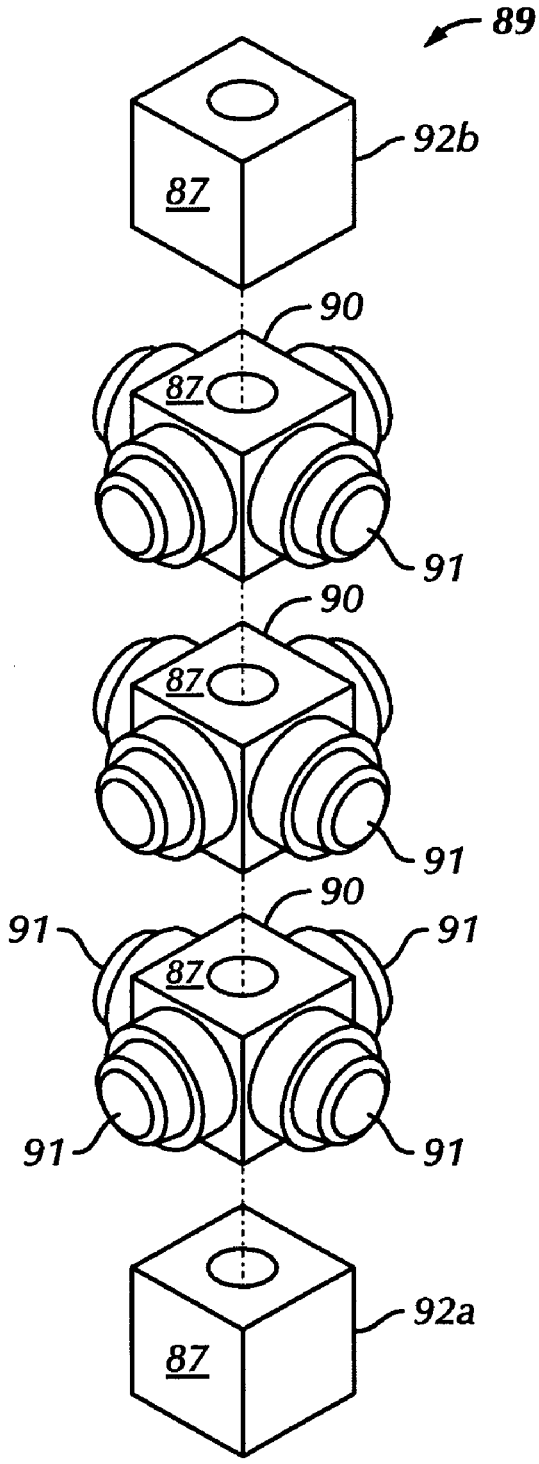
FIG. 9 is an oblique exploded view of the LED assembly of the embodiment of the LED source assembly shown in FIG. 6.
Figure 10:
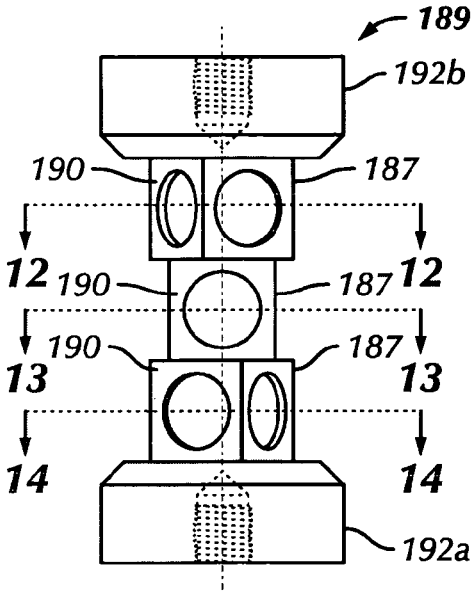
FIG. 10 is a profile view of the LED assembly of the LED source assembly shown in FIG. 7.
Figure 11:
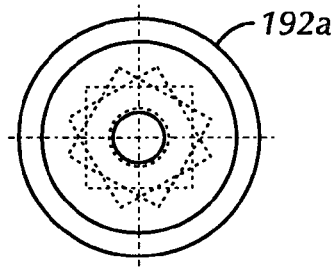
FIG. 11 is a plan view of the LED assembly of the embodiment of the LED source assembly shown in FIG. 7.

The LED assembly 89, used in the first embodiment of the LED source assembly 80, is characterized by three LED modules 90 installed one atop the other as shown in exploded view in FIG. 9. Each LED module 90 contains a heat sink 87 and four outwardly projecting light source LEDs 91 at its mid height, with one of the LEDs 91 centrally positioned on each of the vertical sides of the LED module 90. In the preferred embodiment, the heat sinks 87 are right angle prisms (made out of material such as aluminum alloy) with square horizontal cross-sections.

Each of the LEDs 91 is attached to its respective face of its heat sink 87 with an adhesive such as Loctite Product Output 315, which is a high temperature thermally conductive one-part acrylic adhesive, or a one or two-part epoxy. If an epoxy is used it is preferably compounded with a filler such as aluminum nitride or silver to enhance the thermal conductivity of the adhesive bond so that it will readily conduct heat into the heat sink 87 of the LED module 90.

Each of the LED modules 90 has a vertical through hole on its axis of symmetry. Filler blocks 92*a,b* are constructed identically to the heat sinks 87 of the LED modules 90 but do not have any LEDs 91 attached. Filler blocks 92*a* and 92*b* are respectively located below and above the three stacked LED modules 90 in this preferred embodiment. All of the LED modules 90 and the filler blocks 92*a,b* are aligned with their vertical sides parallel.

Figure 19:
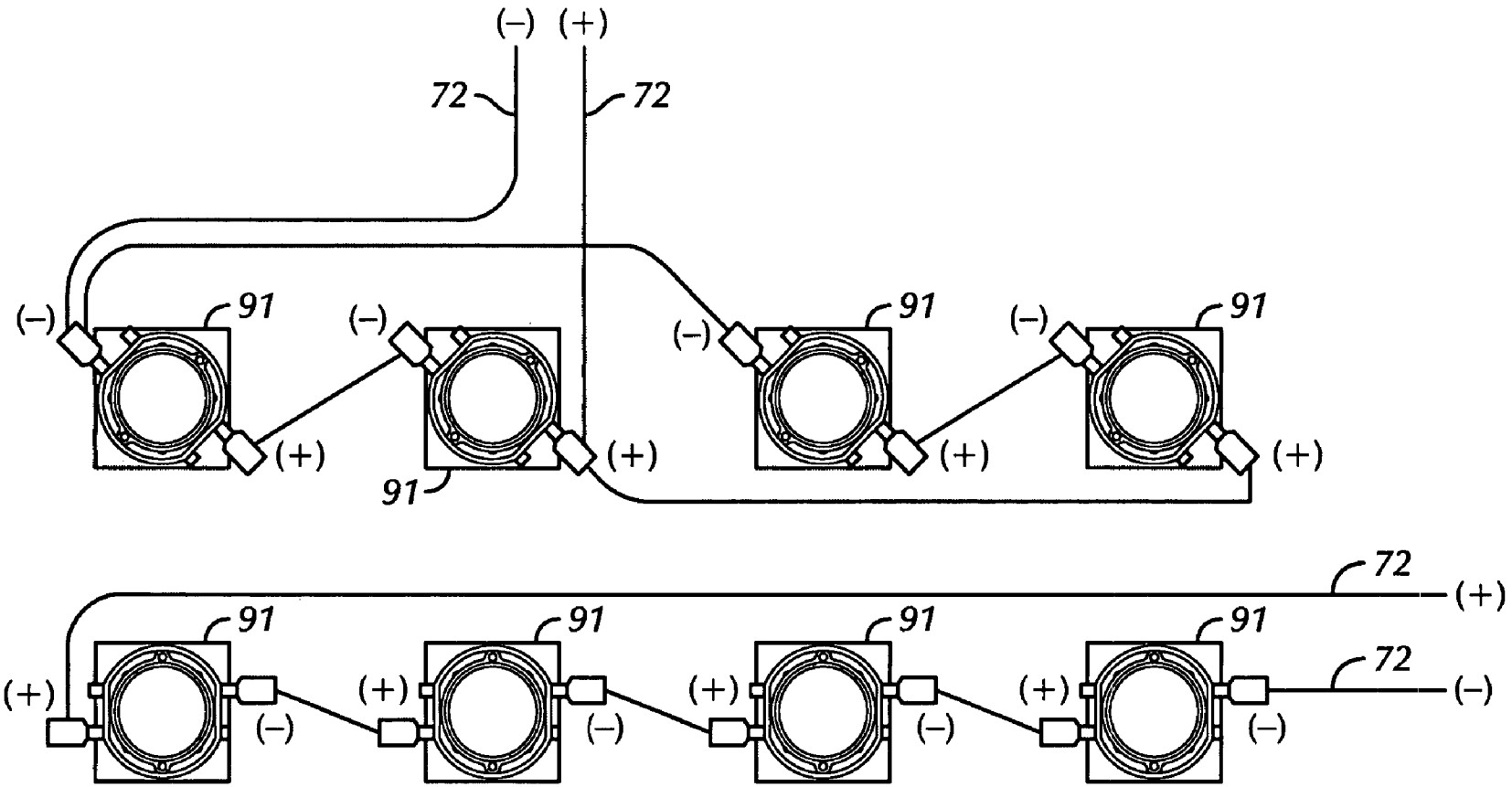
FIG. 19 is a semi-schematic view that illustrates the preferred interwiring of the LEDs as a function of their color and required input voltages.

Each of the LED modules 90 is independently connected to a power supply (not shown) by two insulated wire jumpers 72 attached to the respective terminals of LED power terminal 67 on controller PCB 60 so that electric power can be transmitted individually to each LED module 90 and then to the LEDs 91 for the lighting device 10. The jumpers 72 are passed through one of the primary vent holes 84 of base 81*a* (FIG. 6). The four LEDs 91 within a given LED module 90 are electrically interconnected in series or in parallel serial pairs, all by small wires that are not shown in FIG. 6 for reasons of clarity. One possible wiring scheme is shown in FIG. 19. The required wiring pattern depends on the operating voltages needed for the particular type and color of high flux LEDs 91 being used and the light outputs desired.

The entire LED source assembly 80 is arranged in the following pattern from the bottom to the top. The bottom base 81*a* has the LED assembly 89 concentrically placed with the bottom of filler block 92*a* in firm contact with the upper surface of base 81*a*. Upper base 81*b* is then concentrically placed relative to lower base 81*a* where its grooved lower surface is in firm contact with the top of filler block 92*b* of the LED assembly 89. The firm contact ensures good thermal conductivity across the connections and permits heat absorbed by the heat sinks 87 to flow to the bases 81*a,b*. The firm contact is maintained by using a threaded rod 94 to clamp the entire LED source assembly 80 together. The threaded rod 94 is inserted through the central bore of bases 81*a,b* and LED assembly 89 and holds the LED assembly 89 together by tightening lower lock washer 95*a* and nut 96*a* onto rod 94 as it extends out the bottom of the LED source assembly 80, and upper lock washer 95*b* and nut 96*b* onto rod 94 as it passes out the top of the LED source assembly 80.

Before assembly, O-ring 83*a* (FIG. 7) is placed in groove 82*a* of lower base 81*a*, O-ring 83*b* (FIG. 7) is placed in groove 82*b* of upper base 81*b*. The diffuser 88 is then positioned between and concentric with the two bases 81*a,b*.

The length of diffuser 88 is selected such that the O-rings 83*a,b* are compressed sufficiently to provide sealing but are not over compressed whenever thread rod 94 and the nuts 96*a,b* are used to clamp the LED assembly 89 between the bases 81*a,b*.

LED source assembly 80 is mounted to the center mounting hole of the horizontal central upper section of bracket 58 by means of a lock washer 95*c* and a nut 96*c* (FIG. 4), which threadedly connect to the bottom end of thread rod 94 so that bracket 58 is clamped between the nut 96*a* and the nut 96*c*.

High flux LEDs produce substantial heat compared to lower power LEDs used in earlier beacon devices and marine and airport safety devices. The present invention uses heat sinks 87 to transfer heat away from the LEDs 91. This dissipation of the resultant heat buildup within the lighting device 10 prevents a precipitous reduction in service life for the LEDs 91. The aluminum structures, upon which the LEDs 91 of the present invention are mounted, function as heat sinks 87 so that much of the heat is transferred by conduction to regions in the lighting device 10 that are remote from the LEDs 91 and then transferred to the environment by convection and radiation.

An optional air circulation path exists between the lower base 81*a* and bracket 58 due to the gap created by the presence of washer 95*a* and nut 96*a* (see FIG. 4). Cooling air thus can circulate as a result of thermally induced convection in through vent holes 84 and 85 in the base 81*a*, between LED assembly 89 and diffuser 88, and out through vent holes 84 and 85 in upper base 81*b*. Although an air circulation path is described in this embodiment, the LED source assembly 80 may be sealed to protect the LEDs 91 from moisture. Whenever the LED assembly 89 is sealed, the conduction of generated heat through the heat sinks 87 to the environment is even more important.

The preferred embodiment uses twelve LEDs 91 grouped into three LED modules 90 stacked vertically as shown in FIG. 6. Each LED module 90 contains four LEDs 91 facing 90° apart. One LED module 90 is at the focal height of the lens 37, while the other two LED modules 90 are directly above and below the center level as shown in FIG. 6.

Because the LED array is grouped into three distinct LED modules 90 with each LED module 90 having all four of its LEDs 91 on the same plane, the design allows for each plane of LEDs 91 (each LED module 90) to be independently electrically powered. Therefore, each LED module 90 can be operated at a different power level than the other two LED modules 90.

The middle LED module 90 is located at the focal height of the lantern lens assembly 30 (FIG. 2) which produces the peak intensity. Because the outer two LED modules 90 are above and below the focal height, the light produced by these two LED modules 90 will add primarily to the vertical divergence and not to the peak intensity.

The usual combinations of power levels of the LED modules 90 are: (1) middle level higher power than outer levels; (2) middle level lower than outer levels; and (3) all levels equal.

The reason to power the LED modules 90 independently is to meet certain light output specifications. Some specifications require high peak intensity with a narrow divergence. In that case, only the middle LED module 90 is used. However, a specification often requires a wider divergence, in which case, the outer LED modules 90 are required. By having the ability to tailor how the power is applied in the LED source assembly 80 and specifically to the individual LED modules 90, the present invention is able to meet a wide range of required specifications while achieving power efficiency.

Many applications where these lighting devices 10 will be used are solar powered and these LED source assemblies 80 make efficient use of that power. The following graphs show how the light output is tailored to a specification, whereby in the graphs, the target specification is indicated by a dashed line.

Figure 22:
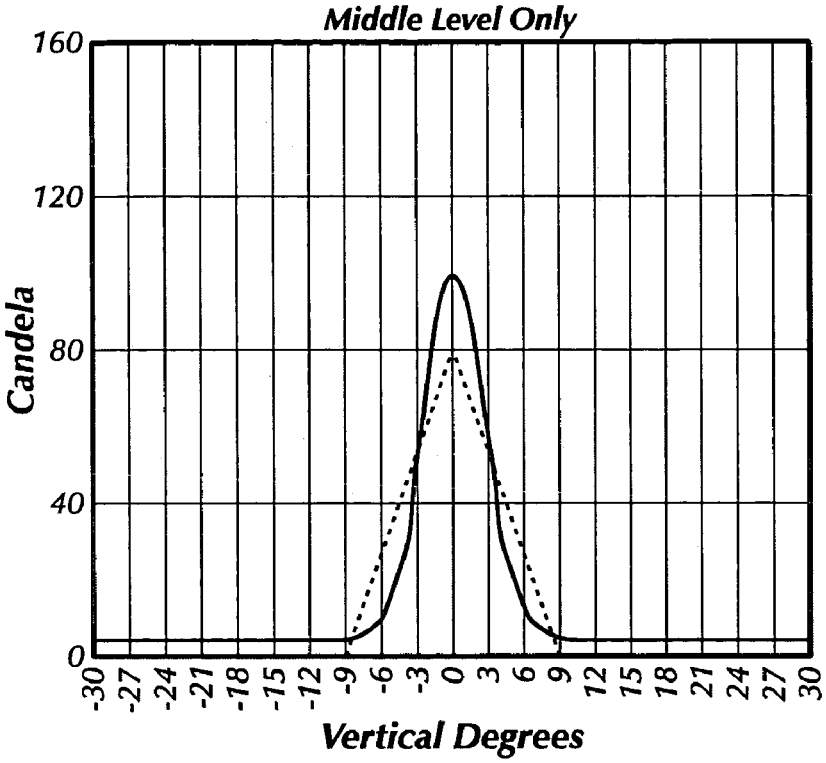
FIG. 22 is a graph showing specification requirements versus the peak intensity and vertical divergence output of the lighting device when the outer levels of LED modules are at 0% of the middle LED module.

In the first graph (FIG. 22), the example configuration (which powers only the middle LED module 90) exceeds the peak intensity requirements but does not meet the vertical divergence requirements.

Figure 23:
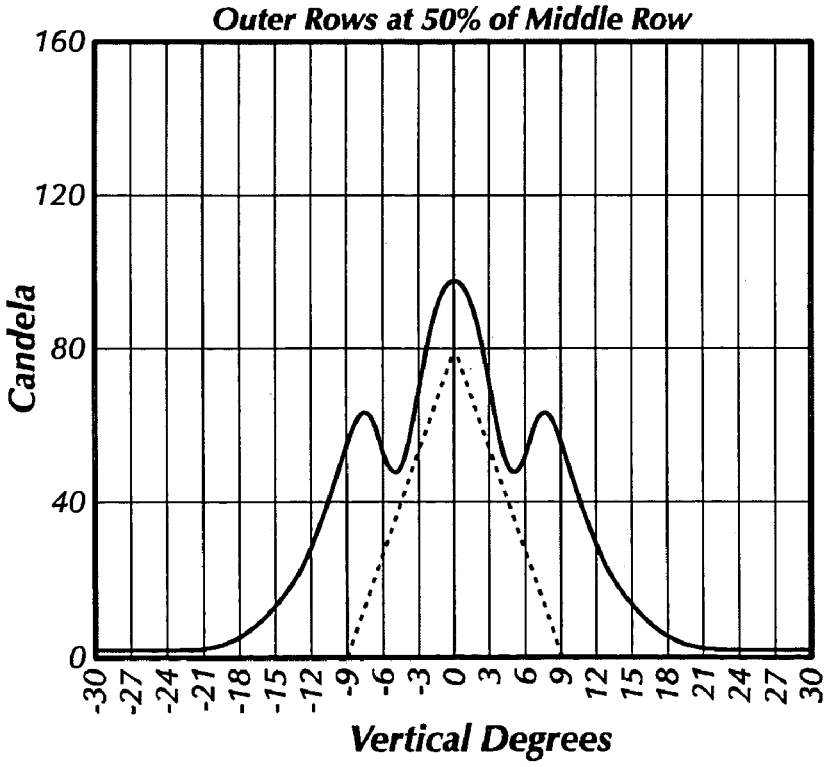
FIG. 23 is a graph showing specification requirements versus the peak intensity and vertical divergence output of the lighting device when the outer levels of LED modules are at 50% of the middle LED module.

By using a lower power level, the LEDs 91 generate less heat thereby increasing the life of the light. Using such power standards, as shown in the second graph (FIG. 23), the lighting device 10 is configured such that the outer LED modules 90 are powered at 50% of the power of the middle LED module 90. This configuration now exceeds the peak intensity and the vertical divergence requirements. Testing of the configuration indicates that 50% of the power of the middle LED module 90 is the minimum power required for the outer LED modules 90 to meet the specifications (peak intensity and vertical divergence requirements).

Figure 24:
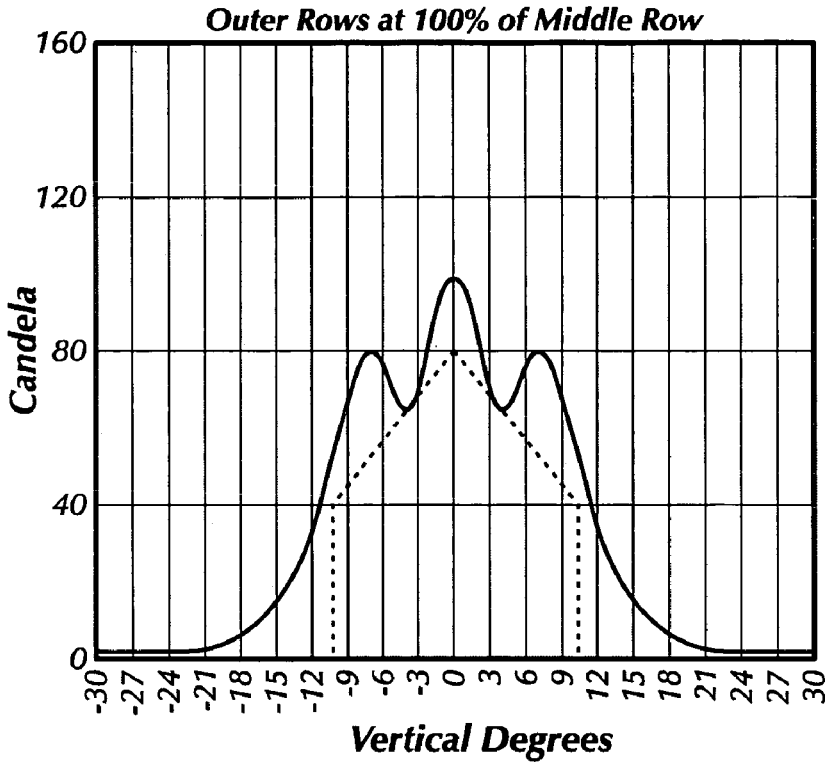
FIG. 24 is a graph showing specification requirements versus the peak intensity and vertical divergence output of the lighting device when the outer levels of LED modules are at 100% of the middle LED module.

In the third graph (FIG. 24), the lighting device is configured with all LED modules 90 having equal power (outer LED modules 90 at 100% of the power of the middle LED module 90) to meet a more demanding specification.

Figure 25:
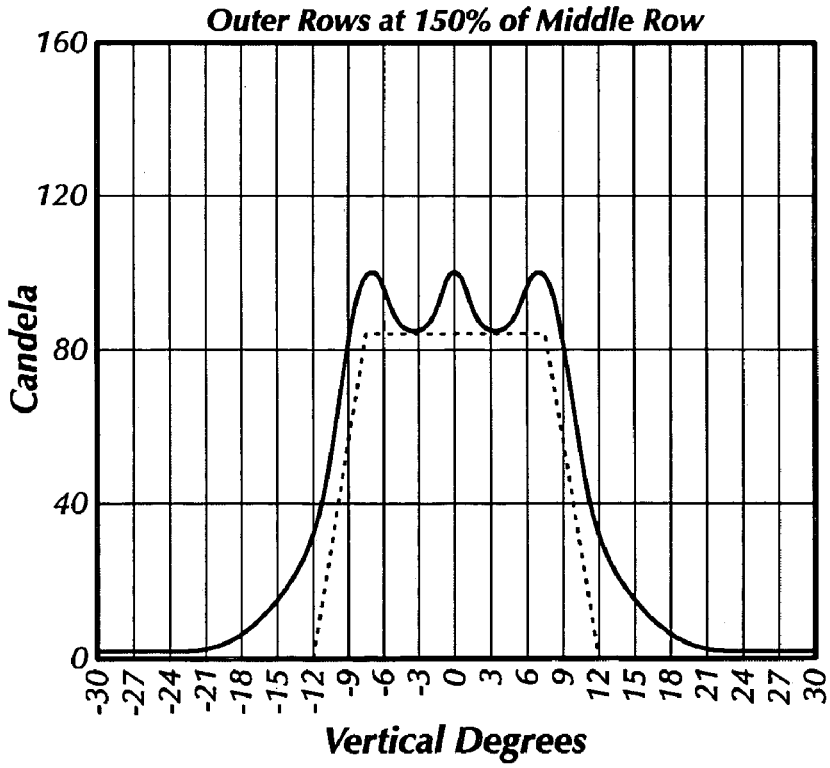
FIG. 25 is a graph showing specification requirements versus the peak intensity and vertical divergence output of the lighting device when the outer levels of LED modules are at 150% of the middle LED module.

In the fourth graph (FIG. 25), the outer LED modules 90 are configured at 150% power of the center LED module 90 to exceed the requirements of a specification that requires a very wide divergence at the peak intensity level.

A second embodiment of an LED source assembly 180, shown in FIG. 7, is designed to be a direct replacement for that used in the first embodiment (element 80 in FIG. 6), so that it can be directly mounted to the top of U-bracket 58 and be operated by the same controller assembly 40 and use the same mounting base 20 and lantern lens assembly 30. The LED source assembly 180 of this embodiment utilizes the same lower and upper bases 81*a,b*, O-rings 83*a,b*, and diffuser 88 as were used in the first embodiment of the LED source assembly 80. For the second embodiment, an LED assembly 189 has the same height as the LED assembly 89 of the first embodiment, but the construction differs as explained below. This embodiment provides an improved angular uniformity of light output in the horizontal midplane (middle LED module 190) of the lighting device 10 as a consequence of having one of at least twelve LEDs 91 emitting light in each of the 30° sectors of the horizontal plane of the LED module 90

FIGS. 10–14 show the construction details of the LED assembly 189, which is made from a single piece of material, such as aluminum alloy, with LEDs 91 attached. The LED assembly 189 has identical, integral, concentric right circular heat sink disks 192*a,b* (at the bottom and top respectively) which have thicknesses equal to approximately one half the diameter of the disks 192*a,b*. These disks 192*a,b* are similar to the filler blocks 92*a,b* of FIG. 6. The diameter of the heat sink disks 192*a,b* is approximately 75% to 80% of the inner diameter of diff-user 88 (FIG. 7), so that when LED assembly 189 is assembled concentrically with the bases 81*a,b*, the primary vent holes 84 of the bases 81*a,b* are not blocked by the LED assembly 189. The-distal ends of the disks 192*a,b* each have coaxial holes drilled to less than the thickness of the disk and are then tapped. The interior ends of the disks 192*a,b* are chamfered.

Figure 12:
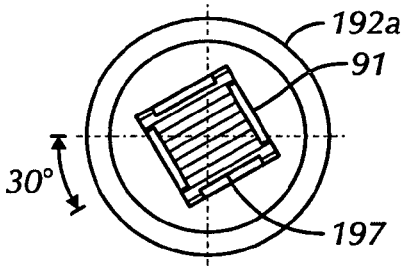
FIG. 12 is a transverse cross-sectional view, cut on the section line 12—12 shown in FIG. 10, of the LED assembly.
Figure 13:
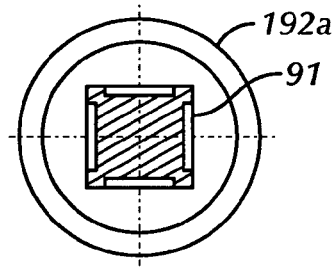
FIG. 13 is a transverse cross-sectional view, cut on the section line 13—13 shown in FIG. 10, of the LED assembly.
Figure 14:
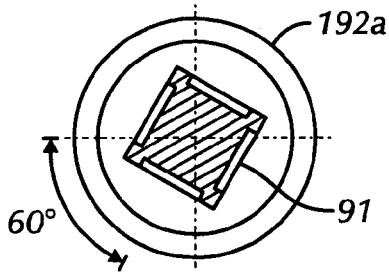
FIG. 14 is a transverse cross-sectional view, cut on the section line 14—14 shown in FIG. 10, of the LED assembly.

The central portion of LED assembly 189 is composed of three different right angle prisms 187 (similar to heat sinks 87 in FIG. 6) with identical square horizontal cross-sections. When viewed from above, the top right angle prism 187 is rotated 30° clockwise, as shown in FIG. 12, and the bottom right angle prism 187 is rotated 60° clockwise, as shown in FIG. 14, about the vertical axis of the LED assembly 189 relative to the middle prism 187. The bottom end of the bottom right angle prism 187 adjoins the interior upper end of disk 192*a*, while the top end of the upper right angle prism 187 adjoins the interior lower end of disk 192*b*. Each of the twelve faces of the set of three right angle prisms 187 has a shallow, flat-bottomed blind hole 197 positioned in the center of its vertical face.

Each right angle prism 187 of the LED assembly 189 mounts an outwardly projecting light source LED 91 in each of the pockets formed by the holes 197. As a result, one LED 91 projects radially every 30° about the vertical axis of LED assembly 189. Each of the LEDs 91 is attached to its respective face of the LED assembly 189 with an adhesive such as Loctite Product Output 315, which is a high temperature thermally conductive one-part acrylic adhesive or a one or two-part epoxy compounded with a filler such as aluminum nitride or silver to enhance the thermal conductivity of the adhesive bond.

The individual LEDs 91 on a given right angle prism 187 (together forming an LED module 190) are electrically interconnected in series or in parallel serial pairs. Each individual LED module 190 is connected separately to its respective power source (not shown) by two insulated wire jumpers 72 attached to the terminals of the LED power terminal 67 on controller PCB 60 so that electric power can be transmitted individually to the different LED modules 190 for the lighting device 10. The jumpers 72 are passed through one of the primary vent holes 84 of base 81*a*. The wiring pattern is dependent on the operating voltages needed for the particular type and color of high flux LED being used and the performance characteristics desired.

The LED source assembly 180 is assembled as shown in FIG. 7. Upper base 81*b* is concentrically placed relative to lower base 81*a*. The grooved lower surface of the upper base 81*b* is in firm contact with the top of the LED assembly 189 and the grooved upper surface of the lower base 81*a* is in firm contact with the bottom of the LED module 189. The firm contact between the bases 81*a,b* and the LED assembly 189 ensures good thermal conductivity across the connections and permits heat absorbed by the LED assembly 189 to flow to the bases 81*a,b*. The firm contact is maintained by clamping the entire LED source assembly 180 by means of screws 193 and lock washers 195 inserted through the central bore of bases 81*a,b* and threadedly connected to the threaded holes on the lower and upper ends of LED assembly 189.

The LED source assembly 180 then is mounted to the spaced-apart mounting holes of the horizontal central upper section 55 of bracket 58 (FIG. 5) with pairs of screws 194 and lock washers 195, which threadedly connect to the threaded holes clamping screw 193 the bottom face of base 81*a*.

An optional air circulation path is created between the lower base 81*a* and bracket 58 due to the gap created by the presence of the screw 193 and the washer 195. Cooling air thus may circulate as a result of thermally induced convection in through vent holes 84 and 85 in base 81*a*, between LED assembly 189 and diffuser 88, and out through vent holes 84 and 85 in upper base 81*b*. Although an air circulation is described for this embodiment, the LED source assembly 180 may be sealed to protect the LEDs 91 from moisture. Whenever the LED source assembly 180 is sealed, the transference of the heat through the heat sinks 192*a,b* and away from the LEDs 91 becomes even more important.

Figure 15:
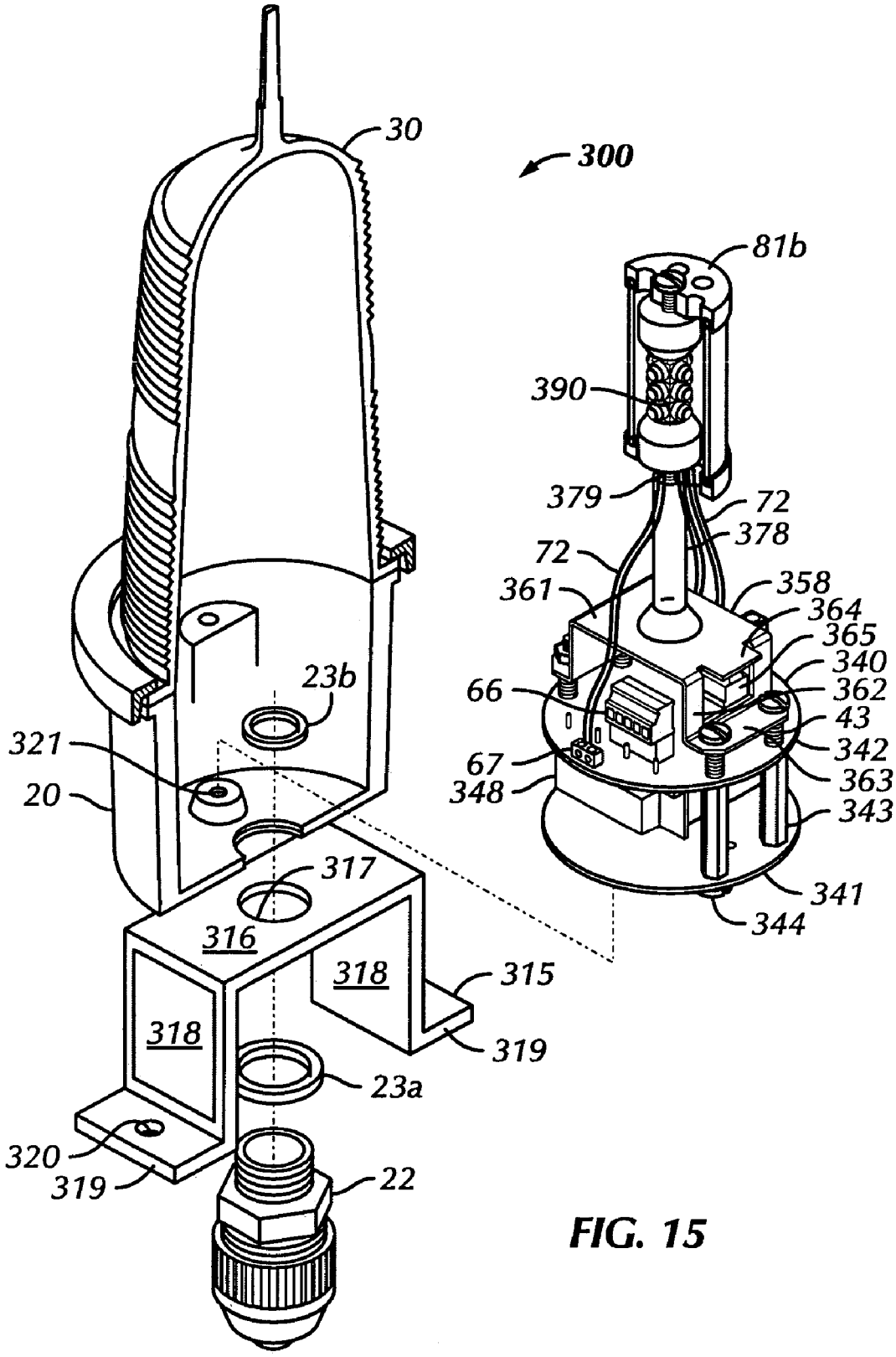
FIG. 15 is a partially exploded oblique view, partially in section, showing details of an alternative embodiment of the controller assembly of an LED source assembly.

Another embodiment of a lighting device 300 of the present invention is shown in an oblique, partially exploded, sectional view in FIG. 15. In this embodiment, the mounting base 20 and lantern assembly 30 which house the components and the sealing cable fitting 22 are the same as in the first embodiment shown in FIGS. 1–2. The lighting device 300, in this embodiment, is mounted on a hat-shaped bracket 315 with the sealing cable fitting 22, which is screwed into the bottom of the mounting base 20 by means of its central threaded hole and sealed by means of gasket 23*a* which closes the possible leak paths between the fitting 22, the mounting base 20, and the bracket 315. The hat-shaped bracket 315 has an elevated horizontal central portion 316 with a central vertical axis hole 317 for the fitting 22, symmetrical vertical legs 318, and outwardly extending horizontal ears 319 with mounting holes 320 for attachment to a supporting piling (not shown). The input power cable (not shown) for the lighting device 300 enters the interior of the lighting device 300 via the sealing fitting 22. This arrangement, without a battery box or solar collector, is typically used with a remote AC power source.

While a controller assembly 340 performs substantially the same functions as the controller assembly 40 in the first embodiment of the lighting device 10, the controller assembly 340 is configured differently. A base plate 341 is a thin circular plate which is attached by screws in holes in plate 341 to coaxial threaded holes in multiple bosses 321 which are on the upper side of the bottom transverse bulkhead of the mounting base 20. A carrier plate PCB 342 is a thin circular printed circuit board (PCB) similar in its geometry to plate 341. It is mounted coaxially with and spaced apart above plate 341 by multiple identical standoffs 343, screws 344 on the connection of the standoffs with plate 341, and the screws of spring mount assemblies 43 for the connection of the standoffs with the carrier plate PCB 342: Similar holes are provided on the same pattern on the periphery of each of plates 341 and 342 in order to accommodate the screws 344 attaching to the standoffs 343.

The carrier plate PCB 342 mounts a power supply assembly 348 on its lower side for rectifying AC power to DC if necessary and conditioning the power output of the power supply 348 by providing voltage stepdown and regulation. The power supply 348 also provides appropriate polarities, current limits, surge protection as required and independent power to the individual LED modules 390. The other individual components of the carrier plate PCB 342 are not shown, but are substantially similar to those employed in the control circuitry of the conventional incandescent light beacon device sold by Automatic Power, Inc., Houston, Tex.

The carrier plate PCB 342 also provides the timing of any typical blinking functions desired for the type of LED light source used. The PCB controller terminal strip 66 is rigidly mounted onto the upper side of the carrier plate PCB 342 on one side and the individual terminals of the PCB terminal strip 66 are attached to appropriate conductor paths on the carrier plate PCB 342. Similarly, a light emitting diode (LED) power terminal 67 for each LED module 390 (each LED power terminal having two terminals), are mounted on the upper side of the carrier plate PCB 342 and interconnected to the appropriate circuit conductor paths on the carrier plate PCB 342. The leads of the input power cable (not shown here) are connected to the appropriate terminals of terminal strip 66 in order to power the carrier plate PCB 342.

A hat-section bracket 358 is centrally mounted above the carrier plate PCB 342 with spring mount assemblies 43 so that the bracket 358 is shock isolated from the rest of the controller assembly 340. The bracket 358 has a horizontal central section 361, two similar, parallel vertical sides 362, and coplanar outwardly projecting mounting ears 363. Multiple holes coaxial with similar holes in the carrier plate PCB 342 serve to provide mounting locations for the spring mount assemblies 43. A tab 364 is cut out of the central portion of one of the vertical sides 362 by making cuts on the vertical sides and bottom of the tab 364. The tab 364 is then bent upwardly so that it projects horizontally as a projection of the central horizontal section 361 of the bracket 358. A hole is punched close to the hinge line for the tab 364 and a supercapacitor 365 is mounted therein.

Figure 16:
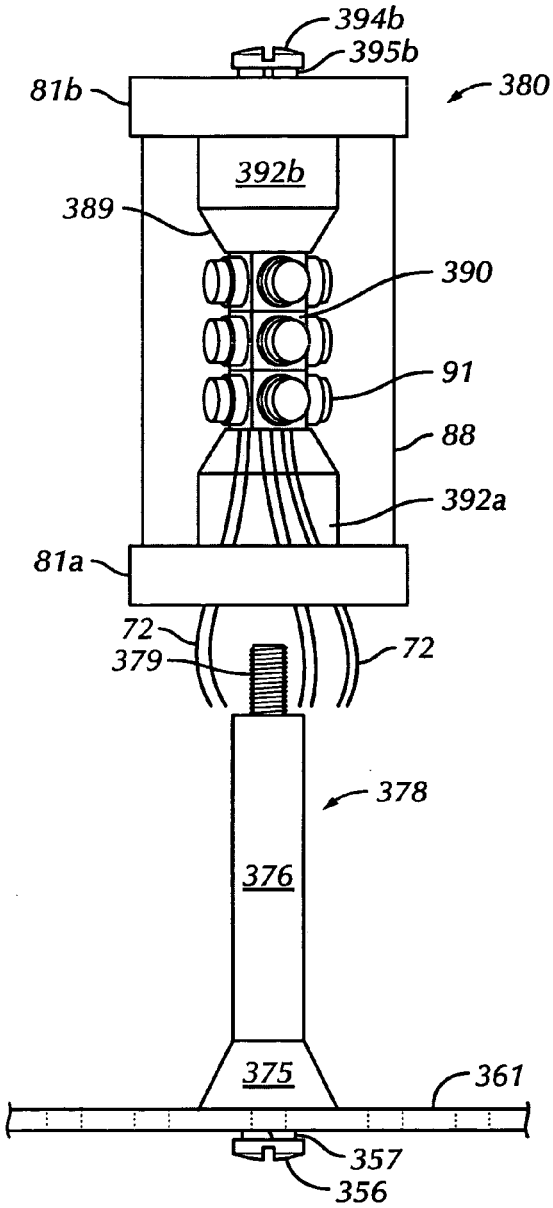
FIG. 16 is a profile view showing details of the mounting of the LED source assembly of FIG. 15.

Referring to FIG. 16, a pylon 378 is mounted to a centrally positioned hole in the horizontal central section 361 of the bracket 358 by means of a screw 356 and a lock washer 357, which are threadedly engaged with a tapped axial hole on the bottom end of the pylon 378. The pylon 378 has a short frustro-conical enlarged base 375 and an extended cylindrical shank 376. The upper end of the pylon 378 is turned down and threaded to form a projecting coaxial screw end 379. An LED source assembly 380 is supported on the pylon 378 by inserting the screw end 379 of the pylon 378 into the axial hole of base 81*a* and thence threading the screw end 379 into the axial tapped hole in the bottom of an LED assembly 389 (FIG. 17).

The upper base 81*b* is then concentrically placed relative to lower base 81*a*. The grooved lower surface of the upper base 81*b* is in firm contact with the top of an LED assembly 389 and the grooved upper surface of the lower base 81*a* is in firm contact with the bottom of the LED assembly 389. The firm contact between the bases 81*a,b* and the LED assembly 389 ensures good thermal conductivity across the connections and permits heat absorbed by the LED assembly 389 to flow to the bases 81*a,b*. The firm contact is maintained on the top side by clamping the entire LED source assembly 380 with screws 394*b* and lock washers 395*b* inserted through the central bore of bases 81*b* and threadedly connected to the threaded holes on the upper ends of the LED assembly 389. The firm contact is maintained on the bottom side by screwing the screw end 379 into the axial hole of base 81*a* and into the bottom of the LED assembly 389.

The LED source assembly 380, as shown in FIG. 16, is designed to be a direct replacement for the first embodiment of the LED source assembly 80. The LED source assembly 380 utilizes the same lower and upper bases 81*a,b*, O-rings 83*a,b*, and diffuser 88 as were used in the first embodiment of the LED source assembly 80. For this embodiment, the LED assembly 389 has the same height as the LED assembly 89 of the first embodiment, but the construction differs as follows.

Figure 17:
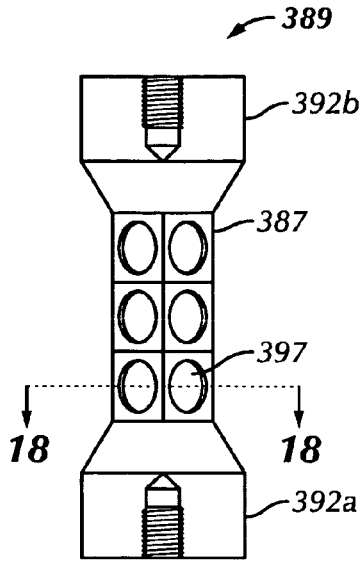
FIG. 17 is a profile view of the LED assembly of the LED assembly of FIG. 16.
Figure 18:
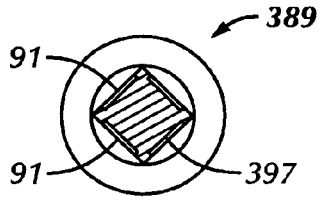
FIG. 18 is a transverse cross-sectional view of the LED assembly of FIG. 17.

FIGS. 17–18 show the construction details of the LED assembly 389, which is made from a single piece of material such as an aluminum alloy. The LED assembly 389 has at each distal end identical, integral, concentric right circular heat sink disks 392*a,b* (similar to the filler blocks 92*a,b* in the first embodiment) that have thicknesses equal to approximately 75% of the diameter of the disks 392*a,b*. The diameter of the heat sink disks 392*a,b* is approximately 75% to 80% of the inner diameter of the diffuser 88, so that when the LED assembly 389 is assembled concentrically with the bases 81*a,b*, the primary vent holes 84 of the bases are not blocked by the LED assembly 389.

The distal ends of the heat sink disks 392*a,b* have coaxial holes drilled to less than the thickness of the disks 392*a,b* and then tapped. The interior ends of the heat sink disks 392*a,b* are chamfered, with the minimum diameter of the chamfers equal to the diagonal dimension of the central portion of the LED assembly 389. The central portion of the LED assembly 389 is composed of three cubic (or nearly cubic) right angle prisms 387 with square horizontal cross-sections (FIG. 17). The upper-most prism 387 adjoins the chamfered interior upper end of disk 392*a*, while the lower-most prism 387 adjoins the chamfered interior lower end of disk 392*b*. Associated with each face of both the top of the upper-most prism 387 and the bottom of the lower-most prism 387 are a pair of horizontal arcuate flats (not shown), which are the transitions between the chamfered shoulders and the right angle prisms 387.

Each of the four faces of each of the right angle prisms 387 has a shallow, flat-bottomed blind hole 397 positioned in the center of its vertical face for mounting an outwardly projecting light source LED 91. As a result, at least one LED 91 projects radially every 90° about the vertical axis of the LED assembly 389. Each of the LEDs 91 is attached to its respective face of the prisms 387 with an adhesive such as Loctite Product Output 315, which is a high temperature thermally conductive one-part acrylic adhesive or a two-part epoxy compounded with a filler such as aluminum nitride or silver to enhance the thermal conductivity of the adhesive bond. An LED module 390 contains one of the prisms 387 and its associated LEDs 91.

One of the LEDs 91 in each of the LED modules 390 is connected by two insulated wire jumpers 72 to the terminals of the LED power terminal 67 on the carrier plate PCB 342 so that electric power can be transmitted individually to the LED modules 390 for the lighting device 300. The jumpers 72 are passed through one of the primary vent holes 84 of base 81*a*. The individual LEDs 91 on the right angle prism 387 of an LED module 390 are electrically interconnected in series or in parallel serial pairs by small wires which are not shown in FIGS. 15–16 for reasons of clarity. The wiring pattern depends on the operating voltages needed for the particular type and color of high flux LEDs 91 being used.

Alternatively, the LED source assembly 380 may be mounted on the PCB bracket 58, similar to LED source assembly 80 as shown in FIGS. 4–5. The LED source assembly 380 is mounted to the spaced-apart mounting holes of the horizontal central upper section 55 of bracket 58 by means of pairs of screws and lock washers which threadedly connect to the threaded holes on the bottom end of base 81*a*. When the LED source assembly 380 is mounted on the PCB bracket 58, a firm contact between the bases 81*a,b* and the LED assembly 389 is maintained to ensure good thermal conductivity between the LED assembly 389 and the bases 81*a,b*. The firm contact is maintained on the top side by clamping the entire LED source assembly 380 by means of a screw 394*b* and a lock washer 395*b* inserted through the central bore of the base 81*b* and threadedly connected to the threaded holes on the upper end of the LED assembly 389. The firm contact is maintained on the bottom side by means of a screw and a lock washer inserted through the central bore of base 81*a* and threadedly connected to the central threaded hole on the lower end of the LED assembly 389.

Figure 20:
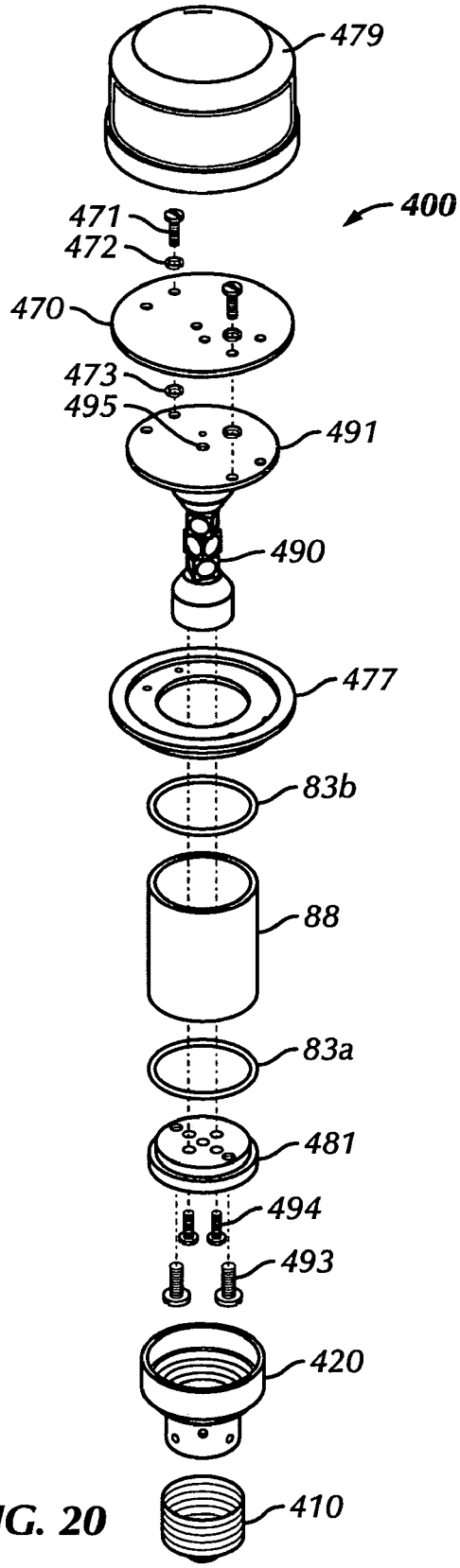
FIG. 20 is an oblique exploded view of another embodiment of the lighting device of the present invention.
Figure 21:
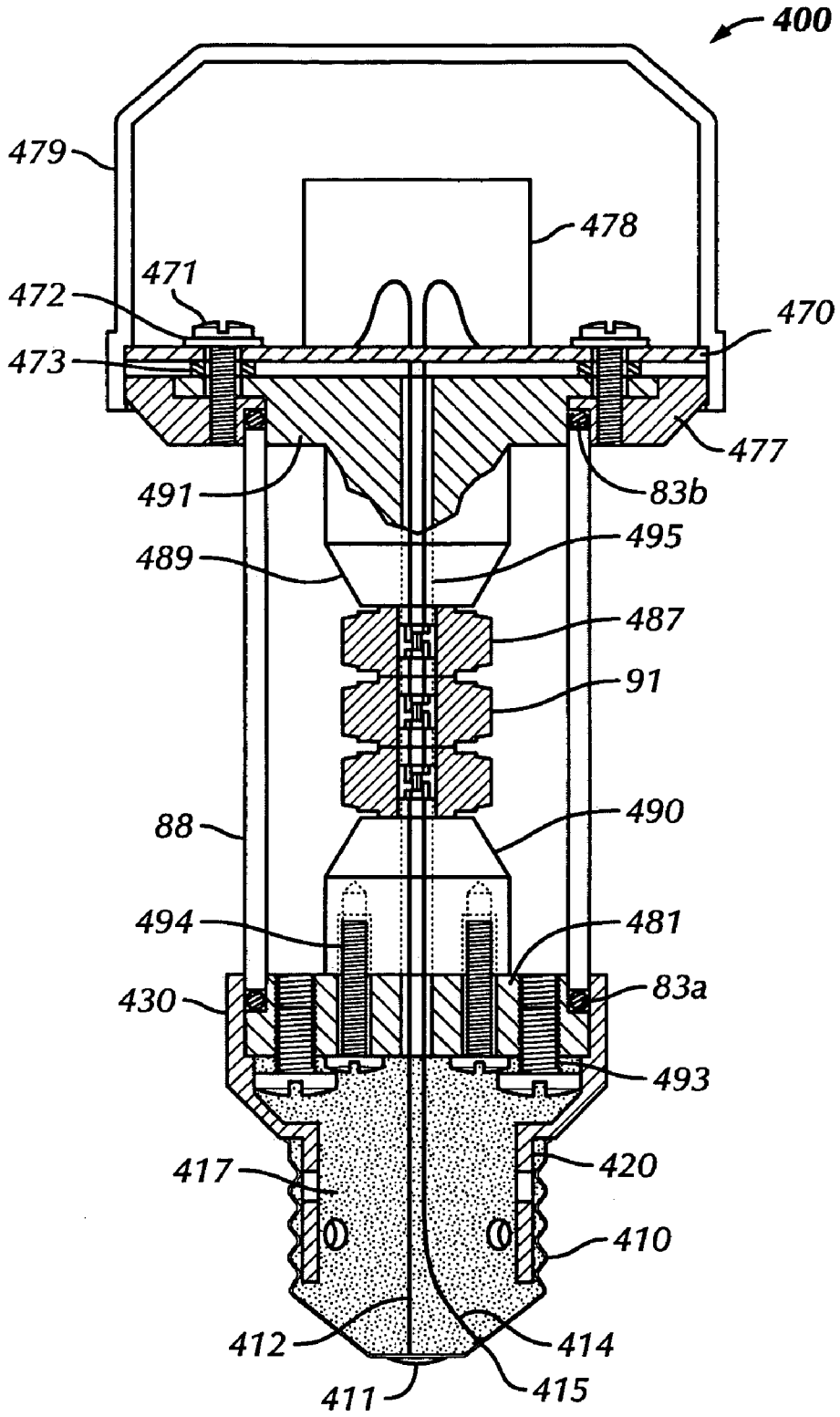
FIG. 21 is a vertical cross-sectional view of the lighting device of the present invention of FIG. 20.

Referring to FIGS. 20–21, another embodiment of a lighting device 400 of the present invention is shown. This embodiment, which has its own (either open-frame or closed-frame) electrical power supply unit 478 for converting the input electric current, is configured to be mounted in a standard screw-in type socket base. A screw plug shell 410 is a substantially constant thickness, thin-walled, modified cylindrical shell. The screw plug shell 410 has, from its upper end, a short straight right circular cylindrical segment, a downwardly extending roll-formed righthand thread compatible with one of the standard sizes of screw-in sockets, and a frustro-conical end which is reduced in diameter on its lower end. The major diameter of the thread is the same as the outer diameter of the upper segment, while the minor diameter is the same as the largest diameter of the frustro-conical lower end. The top end of the screw plug shell 410 is open.

A first input power wire 412 is insulated except on its lower and upper ends. A solder contact button 411 is a highly ovaled ovate spheroid which has a relatively short axial length compared to its diameter. The contact button 411 is positioned coaxially at the lower end of the first wire 412. The first wire 412 is positioned coaxially with the screw plug shell 410 such that the contact button 411 protrudes slightly beyond the lower end of the screw plug shell 410. A second input power wire 414 is insulated except on its lower and upper ends and is soldered at its lower end to the interior lower end of the screw plug shell 410. Although the lower portion of the second power wire 414 is bent slightly, most of the power wire 414 runs adjacent and parallel to the first power wire 412.

A potting cup 420 is an annular cylinder having a thin wall of a constant thickness over most of its length and constructed of a nonconductive compound, such as a high molecular weight high density filled polyethylene or a phenolic resin. Starting from the upper end, the potting cup 420 has a short, right-circular, cylindrical annular section with an upwardly facing first internal transverse shoulder at approximately midlength, joined by a frustro-conical transition to a reduced diameter, an inwardly projecting second transverse shoulder section, and a straight cylindrical section. The length of the lower cylindrical section is equal to approximately half of the overall length of the potting cup 420. The lower cylindrical section is penetrated by multiple radially oriented circular holes. The potting cup 420 is inserted into the larger, upper end of the screw plug shell 410 so that its downwardly facing second transverse shoulder abuts the upper transverse end of the screw plug shell 410.

A lower end plate 481 is a short, right-circular, cylindrical disk (made of a material such as black anodized aluminum) with a larger diameter lower end which has a close slip fit to the upper inner diameter of the potting cup 420, a transverse upwardly facing shoulder, and a smaller diameter upper end which is a close slip fit inside the bore of the diffuser 88. The outer diameter of the lower end plate 481 is the same as that of the diffuser 88. The lower transverse face of the lower end plate 481 rests against the upwardly facing first transverse shoulder of the potting cup 420. The diameter of the upper end is reduced so that it and the upward facing transverse shoulder can serve as two sides of a face-seal O-ring groove for the mounting of O-ring 83*a*. The inner diameter of the upper end of the potting cup 420 then serves as the third side of the face-seal O-ring groove. The disk 481 has an axial through hole for passage of wires 412 and 414 and a first pattern of four equispaced off-axis through holes located on a circle with a diameter equal to about one third of the lower end plate 481 outer diameter. Additionally, two other drilled and tapped-through holes in a second pattern are diametrically opposed and located at radii equal to about two thirds of the outer diameter of lower end plate 481.

The lower end plate 481 is mounted with its axis vertical. Multiple panhead screws 494 are mounted in the first pattern of holes of lower end plate 481 with their threaded ends protruding upwardly above the upper transverse face of the plate to engage an LED assembly 489, as described in a subsequent paragraph. The set screws 493, as shown in FIG. 21, are mounted in the drilled and tapped holes of the second hole pattern and extend upwardly into the lower end plate 481.

The LED assembly 489 is similar in many respects to the LED assembly 389 (FIG. 16), described previously. The LED assembly 489 is made from a single piece of material such as a black anodized aluminum alloy and has at its upper distal end an integral, concentric right circular cylindrical heat sink disk 491 (similar to the upper base 81*b* in FIG. 16).

The lower side of the disk 491 has a downwardly facing horizontal transverse shoulder that extends to a reduced diameter cylinder which in turn is a slip fit into the bore of the diffuser 88. The LED assembly 489 has a coaxial through hole 495 for accommodating wires 412 and 414 and the wiring (not shown) for supplying power to the LEDs 91. The lower transverse end of the LED assembly 489 is provided with a concentric circular pattern of drilled and tapped holes consistent with the pattern in the lower end plate 481 so that screws 494 can be used to attach the lower end plate 481 onto the bottom of the LED assembly 489, as shown in FIGS. 20–21. The upper heat sink disk 491 is also provided with multiple off-axis drilled holes for the mounting of the power supply 478.

The main portion of the LED assembly 489 is a right circular cylindrical shaft having symmetrical frustro-conical transitions to its reduced cross-section central section. The central section of the LED assembly 489 is composed of three cubic (or nearly cubic) right angle prisms 487 with square horizontal cross-sections. Associated with each face of both the top of the upper-most prism 487 and the bottom of the lower-most prism 487 are a pair of horizontal arcuate flats, which are the transitions between the frustro-conical transitions and the right angle prisms 487. Indentations in each of the four faces of each of the right angle prisms 487 provide a mounting surface for LEDs 91. Each of the three LED modules 490 contains one of the prisms 487 and the set of four LEDs 91 that are attached to the prism 487.

The outwardly projecting light source LEDs 91 are attached to the faces of the prisms 487 with an adhesive such as Loctite Product Output 315, which is a high temperature thermally conductive one-part acrylic adhesive or a two-part epoxy compounded with a filler such as aluminum nitride or silver to enhance the thermal conductivity of the adhesive bond.

One LED 91 for each LED module 490 is connected by two insulated wire jumpers (not shown) attached to the power supply 478 so that electric power can be independently transmitted to the LED modules 490 for the lighting device 400. The jumpers are passed through either an off-axis vertical hole in the heat sink 491 or through a radial hole intersecting the axial through hole 495 in the LED assembly 489.

A clamp ring 477 is a horizontal, nonconductive member (made of a material such as plastic) that serves to mount the diffuser 88 and the power supply module 478 to the lighting device 400 when the ring 477 is clamped to the heat sink disk (upper base) 491 of the LED assembly 489. The clamp ring 477 is an annular flat ring with transverse upper and lower surfaces and a right circular cylindrical outer face with a large chamfer on its lower external corner. The clamp ring 477 has a concentric, circular, through-bore with a first downwardly facing counterbore on its lower side and a larger second counterbore on its upper side. The first counterbore is a close slip fit to the exterior of diffuser 88, and the second counterbore is a slip fit to the outer diameter of the heat sink disk 491. Both counterbores are adjoined to the central bore by transverse shoulders. Drilled and tapped vertical off-axis holes are provided on the same pattern as those of the off-axis holes in the heat sink disk 491 for engagement by pan head screws 471 and washers 472, so that the clamping of the clamp ring 477 to the heat sink disk 491 can be accomplished.

A power supply printed circuit board (PCB) 470 is made of conventional nonconductive, printed circuit board material with structural and electrical attachments provided for the schematically shown power supply 478. The wires 412 and 414 are attached to the power supply 478, as are the leads conveying power to the LEDs 91. The power supply 478 operates without use of a transformer and rectifies the input power if it is AC, provides power independently to each of the three LED modules 490, and adjusts the voltage level of the output to conform to the needs of the set of LEDs 91 in each of the LED modules 490.

A snap-on, protective cover 479 is a thin-walled structure (made of a material such as plastic) with a vertical right circular cylindrical side joined to a transverse upper diaphragm by a large chamfer. The lower opening of the cover 479 is slightly enlarged to provide sufficient interference fit to either or both of the outer diameters of the power supply PCB 470 and the clamp ring 477 that the cover can be retained thereon.

The lighting device 400, as shown in FIG. 20, is assembled in two sequential steps. For the first step, before assembly, the clamp ring 477 is concentrically positioned against the lower side of the heat sink plate 491 of the LED assembly 489. A first O-ring 83*b* is placed in the face seal O-ring groove formed between the heat sink plate 491 of the LED assembly 489 and the clamp ring 477. The diffuser 88 is concentrically positioned with its upper end abutting the first O-ring 83*b* in the seal groove. A second O-ring 83*a* is placed concentrically around the reduced-diameter, upper cylindrical face of the lower end plate 481 and then screws 494 are used to connect the lower end plate 481 to the bottom transverse end of the LED assembly 489 using the tapped holes thereon.

The upper end of the potting cup 420 is engaged around the second O-ring 83*a*, the diffuser 88, and the lower end plate 481 so that the upper transverse interior shoulder of the potting cup 420 abuts the lower end of the lower end plate 481. At this point, both O-rings 83*a,b* are sealingly engaged so that the volume enclosed by the diffuser 88 is isolated. The length of the diffuser 88 is selected such that the O-rings 83*a,b* are compressed sufficiently to provide sealing but at the same time are not over compressed whenever the LED assembly 489 is clamped together with the lower end plate 481 by the screws 494. The first input power wire 412 and the second input power wire 414 are then inserted through the axial holes in lower end plate 481 and the LED assembly 489, respectively, as the screw plug shell 410 is concentrically abutted with the intermediate downwardly facing transverse shoulder of the potting cup 420.

For the second assembly step, the elements of the inverted plug base assembly 430 (consisting of the screw plug shell 410, the potting cup 420, the lower end plate 481, wires 412 and 414, and the screws 493 and 494) are potted together with insulative ceramic or plastic potting compound 417, as shown in FIG. 21. The potting compound 417 completely fills the interior of the shell 410 to the bottom end of the screw plug shell 410 and interconnects the elements of the plug base assembly 430. Specifically, the potting compound 417 firmly engages the interior threads of the screw plug shell 410, the radial holes in the potting cup 420, the wires 412 and 414, and the downwardly protruding threaded ends of the set screws 493, so that the assembly 430 is unitized. The contact button 411 protrudes outwardly beyond the end of the screw plug shell 410.

The final assembly steps involve attaching the LED power leads (not shown) from one of the LEDs 91 in each of the LED modules 490 to the electrical power supply PCB 470, along with the upper ends of the input power wires 412 and 414. Screws 471 are then inserted through the provided holes in the PCB 470, the nonconductive plastic tubular standoffs 473 and the off-axis holes in the heat sink disk 491, and then threadedly engaged in the tapped holes provided in the clamp ring 477. The standoffs 473 help isolate the PCB 470 from the head of the heat sink disk 491. The snap-on cover 479 can then be axially engaged by forcing it onto the outer peripheries of the PCB 470 and the clamp ring 477 to complete the assembly of the LED source module 400.

OPERATION OF THE INVENTION

The present invention is a compact, high intensity light source (lighting device), based upon high flux light emitting diodes (LEDs), which is configured in one embodiment to serve as a direct replacement for electrical single bulb incandescent light sources in existing lighting devices for marine, highway and airway traffic. The lighting device 10 of the present invention is particularly suited for marine and airway navigation aids. The lighting device 400 is suitable for a wider spectrum of devices such as standard traffic lights, roadway hazard lights and airport runway lights.

The lighting device 10 of the present invention avoids the need to replace existing lighting fixtures, especially the expensive fresnel lens used to focus the emitted light beam when converting from an incandescent to an LED light source. Prior LED light sources used large quantities of LEDs 91 to get sufficient light output and are physically too large to fit into existing fresnel lenses. Furthermore, prior LED light sources were unsuitable for retrofitting existing lighting fixtures due to the substantial deviation of location from the focal point of existing fresnel lenses.

Conventional single bulb light source filaments for typical navigation aids are very compact and hence closely resemble point sources. Consequentially, the light beam emitted when using the prior LED light sources with the single bulb fresnel lenses is sufficiently unfocused that the required light intensities cannot be obtained. The physical configurations of the LED patterns in the different embodiments of the present invention are sufficiently compact that existing fresnel lenses designed for single incandescent bulb sources can be used successfully. In addition, the compactness of the described LED assemblies allows them to be placed at appropriate positions within the lens of the lantern structure. The sizes and attachment points of the mounting U-bracket and base plate and controller assemblies are also compatible with the mounting base of the large number of existing units based upon commercially available lighting devices such as the marine beacon designs of Automatic Power, Inc., Houston, Tex.

Although the high flux LEDs provide sufficient candlepower, they introduce the necessity to convey heat away from the LEDs to avoid reducing the useful lifespan of the LEDs. This requirement is due to a rapid deterioration in LED useful life when exposed to temperatures elevated above a critical threshold. Since the LED assemblies of this invention are almost fully enclosed or fully enclosed and sealed, use of the thermally conductive support mountings for the LEDs as heat sinks to distribute the heat away from the LEDs increases the life expectancy of the LEDs and further enhances the practicality of the lighting devices of the present invention. This is particularly important for the high flux LEDs. The heat conducted away from the LEDs by the heat sink behavior of the support mountings of the LED assemblies 89, 189, and 389 is conveyed to the bases 81*a,b* where it is radiated away.

Another means of reducing heat output during the operation of the multi-tiered LED source assemblies 80, 180, 380, 480 is to drive the center LED module 90, 190, 390, 490 at a higher power level than used to drive the two outer LED modules. Preferably, the center LED module that is positioned at the focal point of the fresnel lens 87 is run at 80%–100% full power, while the top and bottom tiers of LED modules are driven at 30%–60% of full power. The differential powering of the LED modules provide a lighting device 10, 300, 400 that operates more efficiently, produces less heat, and provides increased vertical divergence. The increased vertical divergence observed in these lighting devices (such as marine lanterns) is great for such lighter devices as marine and airway navigational lights, increasing their visibility to six or seven miles.

Furthermore, the high flux LEDs 91 offer the advantage of minimizing the number of LEDs required and thereby permit construction of a sufficiently compact light source to approximate a point source. The rather narrowly focused light output of the commercially available LEDs causes the light emitted by the LED assemblies 89, 189, 389, 489 of the present invention to be nonuniformly distributed in spherical coordinates. This poor light distribution of the unsupplemented LED assemblies precludes their usefulness in certain navigation aid lighting devices. This deficiency is substantially eliminated in the present invention by addition of the tubular glass diffuser 88, having a dentated surface with a roughened microfinish, closely spaced in proximity around the LED source assemblies.

The resulting refractive redistribution by the diffuser 88 of the impinging light from the LEDs 91 (as measured in spherical coordinates for the range of emission angles possible with the assembled structure of the nontransparent components of each of the LED source assemblies 80, 180, 380, 480) results in a more uniformly reemitted light pattern. The approximation to uniformity of the reemitted light from the diffuser 88 is sufficient to permit using the embodiments of the present invention as a substitute for existing navigation aid incandescent bulb light sources.

The general operation of the lighting device is mounted on a supporting structure, such as the marine piling 2 that is shown in FIG. 1. The mounting base 20 and lantern assembly 30 are generally common to the various embodiments of lighting device 10, since the controller assembly 40 and LED source assemblies 80, 180, 380, 480 are all designed to be retrofits into existing units in the field.

The mounting base 20 provides a housing for the controller assembly 40 and serves as a base for stable support of the lantern lens assembly 30. The controller assembly 40 and 478 serves to condition the power provided to operate the LCD assembly 89, 189, 389, 489 of the lighting device 10, 300, 400 so that it is delivered at the proper voltage, has current limiters, and other desirable features. Since many navigation aids are required to flash in a prescribed, regular pattern, the controller assembly 40 or 478 provides power level, control and timing functions to cause its output power to the light source to turn on at the desired power level and only when it is required (such as during darkness) and to cycle on and off in order to cause flashing in any prescribed pattern. All of these functions are standard requirements for beacons and marine lighting devices used in existing navigation aids.

The structure of the LED source assemblies all have certain key features in common, in that all use a diffuser 88 mounted in the same manner with O-rings 83*a,b* in grooves 82*a,b* in the end bases 81*a,b*, 381*ab*, 481 and 491. The primary differences in LED mounting construction lie in the number of LEDs required and the arrangement of the LEDs 91 and the structural supports for the LEDs so that construction of the LED source assemblies is eased and the LED assemblies can properly reject the heat produced by the LEDs 91. Besides providing structural support for mounting and aligning the LEDs 91, each of the LED modules 90, 190, 390, 490 provides a heat sink 87, 187, 387, 487 and a path for conductive heat transfer to the end bases 81*a,b*, 381*a,b*, 481 and 491 of the LED source assemblies so that the excess heat load from the LEDs 91 can be released through radiation. Whenever the LED source assemblies are not sealed and an air circulation path is provided, the heat is also removed via convection with the circulating air within the lantern lens assembly 30. The heat is then released to the walls of the lantern lens assembly 30 and housing (mounting base) 20 and, in turn, to the external environment. The required size of the LED modules is related to the heat generated by its set of LEDs 91, with higher heat fluxes requiring larger heat sinks in order to hold the LED temperature below the critical threshold at which LED life is precipitously reduced.

The construction of the LED source assemblies is sufficiently compact to permit their use with preexisting fresnel lenses 37, since the LEDs 91 in the array for the different types of LED assemblies are positioned closely enough to the focal point of the lenses 37 to avoid excessive divergence of the emitted light from the lenses 37.

The provision of the diffuser 88 smoothes and tends to uniformize the spherical distribution of output light reradiated from the diffuser 88 relative to the input closely focused narrow beam outputs directly from the LEDs 91. This critical feature removes the need to provide a very large array of LEDs so that their overlapping patterns of radiated light will closely approximate a uniform light source. Without provision of the diffuser 88 of the present invention, it would be impractical to use a lighting device having as few as 12 equispaced LEDs, since the distribution in the horizontal plane of light emitted from the lens 37 with such an array would have an insufficient intensity in the arc segments between the LED projection centerlines.

The lighting device 400 with its threaded base offers a convenient unitized light source which can be installed by simply screwing it into a standard threaded socket. Because the power supply 478 is not based upon use of a transformer, the power supply can operate on any AC input voltage over a broad range of, say, between 85 VAC and 265 VAC. This permits the same LED source module to work in both Europe and the United States, thereby simplifying stocking of inventory.

Although the lighting device 400 can be used in a lighting fixture with a fresnel lens, it is anticipated that it will more commonly be used in applications without the fresnel lens. However, the use of the diffuser 88 and the resultant uniform distribution of light make the lighting device 400 particularly suitable for a wide variety of applications, such as aviation runway lights, marker lights for marine bridges and piers, hazard lights, marker lights for towers and buildings, and traffic lights. The LED assembly 489 uses a similar but integral heat sink disk for conducting heat away from its LEDs 91. Its relatively low construction cost and long life can permit the sealed LED source module 400 to be employed economically on a throw-away basis As can be seen by the above described embodiments, the ability to independently adjust the power for different levels of LEDs allows a single lighting device to be set up for differing specifications. Additionally, existing lanterns (not shown) can be retrofitted with the multiple-level, independent power technology to provide independent, adjustable power to each of the LED assemblies.

Although the present invention and its advantages have been described in detail, it should be understood that various changes, substitutions and alterations can be made herein without departing from the spirit and scope of the invention as defined by the appended claims.

What is claimed is:

1. A lighting device comprising:

(a) an LED assembly comprising:

(i) a central member made of a thermally conductive material;

(ii) a plurality of LED modules connected to a central portion of the central member, wherein the LED modules are centralized right angle prisms with a square horizontal cross-section with four vertical sides; and (iii) a plurality of LEDs disposed in a radial array about the vertical axis of each LED module, wherein the heat generated by the LEDs is transferred through the LED module to the central member;

(b) a power source for providing electrical power independently to each LED module to allow the LED modules to operate at different power levels; and (c) a hollow, approximately cylindrical member positioned around the LED assembly.

2. The lighting device of claim 1, wherein the LED modules are stacked about a vertical axis of the LED assembly.

3. The lighting device of claim 2, wherein each LED module is rotated about 30° about the vertical axis of the LED assembly from the adjacent LED module.

4. The lighting device of claim 1, wherein the LED modules are rectangular.

5. The lighting device of claim 1, wherein the LED modules are made of a thermally conductive material.

6. The lighting device of claim 1, wherein the central member is in contact with a thermally conductive element, a portion of the thermally conductive element in contact with the air outside the lighting device.

7. The lighting device of claim 1, wherein the central member is in contact with the air outside the lighting device.

8. The lighting device of claim 1 having twelve or less LEDs.

9. The lighting device of claim 1, wherein each LED module has four LEDs spaced 90° apart in a common horizontal plane.

10. The lighting device of claim 1, wherein the lighting device further comprises a power controller for regulating the polarity, voltage, and current limits of the electricity going to the LEDs.

11. The lighting device of claim 1, wherein the lighting device further comprises a power controller programmed to provide differential amounts of power to at least two of the LED modules.

12. The lighting device of claim 1, wherein the cylindrical member diffuses the light emitted from the LEDs.

13. The lighting device of claim 1, wherein the cylindrical member has a roughened microfinish with a random pattern of microfaceted angles on at least one surface.

14. The lighting device of claim 1, wherein the cylindrical member has a dentated surface.

15. The lighting device of claim 1, wherein the cylindrical member is made of an optically transparent, heat resistant material.

16. The lighting device of claim 1 designed to fit within a fresnel lens of a navigational light.

17. The lighting device of claim 1, further comprising a threaded light socket base.

18. The lighting device of claim 1, further comprising an upper base and a lower base wherein the cylindrical member is mounted between the upper and lower bases.

19. A lighting device comprising:

(a) an LED assembly comprising:

(i) a central member made of a thermally conductive material;

(ii) a plurality of LED modules connected to a central portion of the central member, wherein the LED modules are centralized right angle prisms with a square horizontal cross-section with four vertical sides; and (iii) a LED secured to each vertical side of the LED module, wherein the heat generated by the LEDs is transferred through the LED module to the central member;

(b) a power source for providing electrical power independently to each LED module to allow the LED modules to operate at different power levels; and (c) a hollow, approximately cylindrical member positioned around the LED assembly.

20. The lighting device of claim 19, wherein the LED modules are stacked about a vertical axis of the LED assembly.

21. The lighting device of claim 19 having three stacked LED modules.

22. The lighting device of claim 19, wherein each LED module has four LEDs spaced 90° apart in a common horizontal plane.

23. The lighting device of claim 20, wherein each LED module is rotated about 30° about the vertical axis of the LED assembly from the adjacent LED module.

24. The lighting device of claim 20, wherein one LED projects radially every 30° about the vertical axis of the LED assembly.

25. The lighting device of claim 19, wherein the cylindrical member has a roughened microfinish with a random pattern of microfaceted angles on at least one surface to diffuse the light emitted from the LEDs.

26. The lighting device of claim 19 further comprising a fresnel lens disposed about the vertical axis surrounding the cylindrical member.

27. The lighting device of claim 26, wherein the LEDs are centrally positioned within the fresnel lens.

28. The lighting device of claim 19, further comprising a threaded light socket base.

29. The lighting device of claim 19 having means for air circulation through the lighting device.

* * * * *